US011104142B2

(12) United States Patent
Yoda et al.

(10) Patent No.: US 11,104,142 B2
(45) Date of Patent: Aug. 31, 2021

(54) LIQUID EJECTING APPARATUS

(71) Applicant: SEIKO EPSON CORPORATION, Tokyo (JP)

(72) Inventors: Hiroyuki Yoda, Shiojiri (JP); Shintaro Komuro, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/815,768

(22) Filed: Mar. 11, 2020

(65) Prior Publication Data

US 2020/0290381 A1 Sep. 17, 2020

(30) Foreign Application Priority Data

Mar. 13, 2019 (JP) ..... JP2019-046385

(51) Int. Cl.
*B41J 2/17* (2006.01)
*B41J 2/165* (2006.01)

(52) U.S. Cl.
CPC ..... *B41J 2/1721* (2013.01); *B41J 2/16517* (2013.01); *B41J 2002/1728* (2013.01)

(58) Field of Classification Search
CPC .... B41J 2/1721; B41J 2/16517; B41J 2/1652; B41J 2002/1728; B41J 2/185; B41J 2002/1856; B41J 29/13; B41J 29/02; B41J 2/01; B41J 35/38; B41J 2002/1735; B41J 2002/1742; B41J 2/17509
See application file for complete search history.

(56) References Cited

U.S. PATENT DOCUMENTS

2005/0151782 A1 7/2005 Ishida et al.

FOREIGN PATENT DOCUMENTS

| | | |
|---|---|---|
| CN | 108859421 | 11/2018 |
| JP | 2006-035662 | 2/2006 |
| JP | 2018-187888 | 11/2018 |

*Primary Examiner* — Kristal Feggins
(74) *Attorney, Agent, or Firm* — Workman Nydegger

(57) ABSTRACT

A liquid ejecting apparatus includes a transport section which transports a medium in a transport direction, a liquid ejecting head which ejects a liquid onto the medium, a carriage which supports the liquid ejecting head, a liquid storage container which stores the liquid to be supplied to the liquid ejecting head, and an discharge section which discharges the medium onto which the liquid is ejected. The liquid ejecting apparatus further includes a holding section which holds a waste liquid box configured to store the liquid eliminated from the liquid ejecting head as a waste liquid. The holding section is disposed at a position downstream of the carriage in the transport direction and above the discharge section.

13 Claims, 14 Drawing Sheets

LIQUID EJECTING APPARATUS

The present application is based on, and claims priority from JP Application Serial Number 2019-046385, filed Mar. 13, 2019, the disclosure of which is hereby incorporated by reference herein in its entirety.

BACKGROUND

1. Technical Field

The present disclosure relates to a liquid ejecting apparatus provided with a liquid ejecting head which ejects a liquid onto a medium and a waste liquid storage body which stores the liquid eliminated from the liquid ejecting head as a waste liquid.

2. Related Art

JP-A-2006-35662 discloses a multifunction device (an example of a liquid ejecting apparatus) provided with a recording section including a liquid ejecting head. The multifunction device is provided with a transport mechanism, which transports a medium such as a recording paper, and prints on the medium by discharging a liquid such as an ink from the liquid ejecting head onto the transported medium. In the multifunction device, a waste liquid absorbing member, which absorbs an ink waste liquid discharged from a nozzle of the liquid ejecting head during maintenance work carried out using a maintenance device, is installed on the rear of the recording section. In other words, in the multifunction device, the waste liquid absorbing member is installed on the rear side on the inside of a housing. The waste liquid absorbing member may be installed as a waste liquid storage body stored in a container for waste liquid leakage prevention.

However, in a liquid ejecting apparatus such as the multifunction device, at the point at which the waste liquid storage body is disposed at the rear portion of the housing, there is a problem in that the workability of the exchanging work of the waste liquid storage body is poor. For example, when the liquid ejecting apparatus is installed such that the rear surface thereof is against a wall, it is necessary to change the orientation of the liquid ejecting apparatus, to move the liquid ejecting apparatus, or the like in order to secure working space to exchange the waste liquid storage body and the workability during the exchanging of the waste liquid storage body is poor. Therefore, there is a demand for the workability to be favorable during the exchanging of the waste liquid storage body. On the other hand, there is also a demand to avoid an increase in the size of the liquid ejecting apparatus as much as possible.

SUMMARY

According to an aspect of the disclosure, a liquid ejecting apparatus includes a transport section which transports a medium in a transport direction, a liquid ejecting head which ejects a liquid onto the medium, a head support portion which supports the liquid ejecting head, a liquid storage container which stores the liquid to be supplied to the liquid ejecting head, an discharge section which discharges the medium onto which the liquid is ejected, and a holding section which holds a waste liquid storage body configured to store the liquid eliminated from the liquid ejecting head as a waste liquid, in which the holding section is disposed at a position downstream of the head support portion in the transport direction and above the discharge section.

DESCRIPTION OF EXEMPLARY EMBODIMENTS

Figure 1:
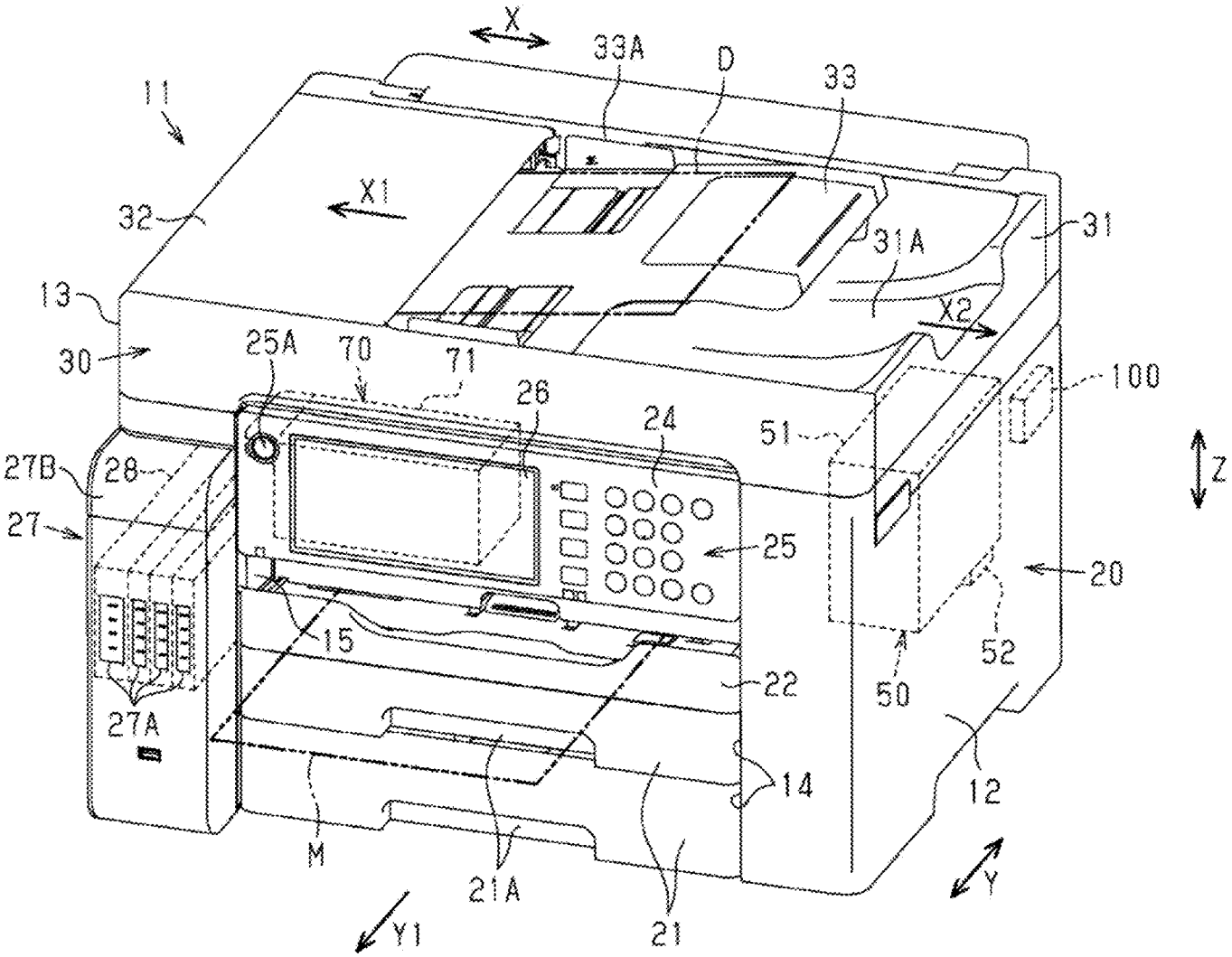
FIG. 1 is a perspective view of a liquid ejecting apparatus of an embodiment.

Hereinafter, a description will be given of an embodiment of a liquid ejecting apparatus with reference to the drawings. In FIG. 1, a liquid ejecting apparatus 11 is assumed to be placed on a horizontal surface and three mutually orthogonally intersecting virtual axes are set to an X-axis, a Y-axis, and a Z-axis. The X-axis is a virtual axis parallel to a scanning direction of a liquid ejecting head (described later) and the Y-axis is a virtual axis parallel to a transport direction of a medium during the printing. The Z-axis is a virtual axis parallel to a vertical direction Z1. One of the directions parallel to the Y-axis is a transport direction Y1 of the medium during the printing. In the Y-axis, a surface on a side on which an operation panel (described later) is disposed on a housing 12 is referred to as a front surface and a surface on the opposite side from the front surface is referred to as a rear surface.

The liquid ejecting apparatus 11 illustrated in FIG. 1 is a serial printing system ink jet printer. As illustrated in FIG. 1, the liquid ejecting apparatus 11 is provided with the rectangular parallelepiped housing 12 and an openable/closable cover 13 which covers an opening 12A in the top portion of the housing 12. The cover 13 is provided to be capable of opening and closing centered on a pivoting shaft (not illustrated) positioned on the rear side in a closed state in which the cover 13 covers the opening 12A (refer to FIG. 2) of the housing 12 and an open state that exposes the opening 12A of the housing 12. The liquid ejecting apparatus 11 is a multifunction device, for example, and includes a printing unit 20 that occupies a large portion of the housing 12 and a reading unit 30 configured by a top end portion of the housing 12 and the cover 13.

Cassettes 21 which store recording media M such as paper (hereinafter, also referred to simply as "the medium M") is inserted, to be capable of attaching and detaching, into a recessed portion 14 provided in the front bottom portion of the housing 12. A plurality of the media M is stored in the cassettes 21. An operation target section 21A which may be attached and detached by a user grasping the operation target section 21A with the fingers of the user is provided at the front center portion of each cassette 21. In the example illustrated in FIG. 1, the cassettes 21 are provided in two levels lined up in the vertical direction Z1. The number of the cassettes 21 may be one and may be a plurality of three or more.

An discharge port 15 from which the printed medium M is discharge is opened at a position above the cassettes 21 in the housing 12. An extending/contracting discharge tray 22 configured to be multi-level is provided between the discharge port 15 and the cassettes 21. The discharge tray 22 is used in a state of being extended downstream in the transport direction Y1 and the post-printing medium M discharge from the discharge port 15 is stacked on the discharge tray 22. An operation panel 24 is provided at a position above the discharge port 15 on the housing 12. The operation panel 24 is provided with an operation section 25 formed of a plurality of switches to be manipulated when giving instructions to the liquid ejecting apparatus 11 and a display section 26 on which menus, various messages, and the like are displayed. The operation section 25 includes a power switch 25A, a selection switch, and the like. Here, the display section 26 may be configured using a touch panel, and in this case, the operation function of the display section 26 may also serve as a portion of the operation section 25. In the drawings, a direction parallel to the X-axis is a first scanning direction X1 and a direction opposite to the first scanning direction X1 is a second scanning direction X2.

As illustrated in FIG. 1, the cover 13 is configured by the reading unit 30 in the present example. The reading unit 30 is provided with a document table cover 31. An automatic document feeding device 32 (an auto document feeder) provided with a document tray 33 on which a plurality of sheets of documents may be placed is equipped on the top portion of the document table cover 31. The reading unit 30 is provided with a sheet feeder type scanner function and a flatbed type scanner function. The sheet feeder type scanner function feeds a document D positioned in the width directions by an edge guide 33A from the document tray 33 one sheet at a time to read the document D and the flatbed type scanner function reads the document D placed on a document table that is exposed when the document table cover 31 is opened. The documents D read by the reading unit 30 one sheet at a time using the sheet feeder type scanner function are stacked on an discharge tray 31A on the document table cover 31.

In addition to a printing function of printing on the medium M using an ink jet system, the liquid ejecting apparatus 11 which is a multifunction device is provided with a scanner function in which the reading unit 30 reads the document D and a copy printing function of printing an image of the document D read by the reading unit 30 onto the medium M.

As illustrated in FIG. 1, a liquid supplying unit 27 is provided on one end portion on the front portion of the housing 12. A plurality of liquid storage containers 28 (also refer to FIG. 2) is stored inside the liquid supplying unit 27 and each of the liquid storage containers 28 stores a liquid such as an ink. Each of the plurality of liquid storage containers 28 stores an ink having a different color, for example, black, cyan, magenta, and yellow. The liquids stored by the liquid storage containers 28 are used for the liquid ejecting apparatus 11 to eject and print onto the medium M. The front surface of the liquid supplying unit 27 includes a plurality of window portions 27A through which it is possible to visually recognize the amount of liquid for each of the liquid storage containers 28. The liquid storage containers 28 are ink tanks, for example.

The top portion of the liquid supplying unit 27 includes a cap portion 27B capable of being opened and closed. For example, when the window portions 27A are viewed and the liquid amount is depleted, the user opens the cap portion 27B and pours a liquid such as an ink from an ink bottle, for example, into a supply port (both omitted from the drawings) of the liquid storage containers 28 to perform resupplying. The liquid storage containers 28 are not limited to being a pouring system in which it is possible to pour a liquid, and may be ink cartridges or ink packs of an exchanging system.

A carriage unit 50 capable of reciprocally moving along the X-axis is provided inside the housing 12. The carriage unit 50 is provided with a carriage 51 supported to be capable of reciprocally moving along the X-axis and a liquid ejecting head 52 which is installed on the carriage 51 and ejects the liquid onto the medium M. The carriage 51 of the present embodiment configures an example of the head support portion which supports the liquid ejecting head 52. The carriage unit 50 is a so-called off-carriage type which receives a supply of the liquid from the liquid storage containers 28 disposed at a different position from the carriage 51. A waste liquid unit 70 is disposed at a position corresponding to the reverse surface of the operation panel 24 inside the housing 12. The waste liquid unit 70 collects the liquid such as the ink that is ejected or eliminated from the liquid ejecting head 52 for a purpose other than printing as a waste liquid. The waste liquid unit 70 is provided with an attaching/detaching waste liquid box 71 as an example of the waste liquid storage body. The liquid ejecting apparatus 11 is provided with a control section 100 illustrated in FIG. 1 which controls the printing unit 20 and the reading unit 30. In the present embodiment, although the control section 100 is disposed at an end portion position close to the waiting position of the carriage unit 50 illustrated in FIG. 1 in a direction along the X-axis inside the housing 12, the control section 100 may be disposed at the end portion position of the opposite side from the waiting position.

Figure 2:
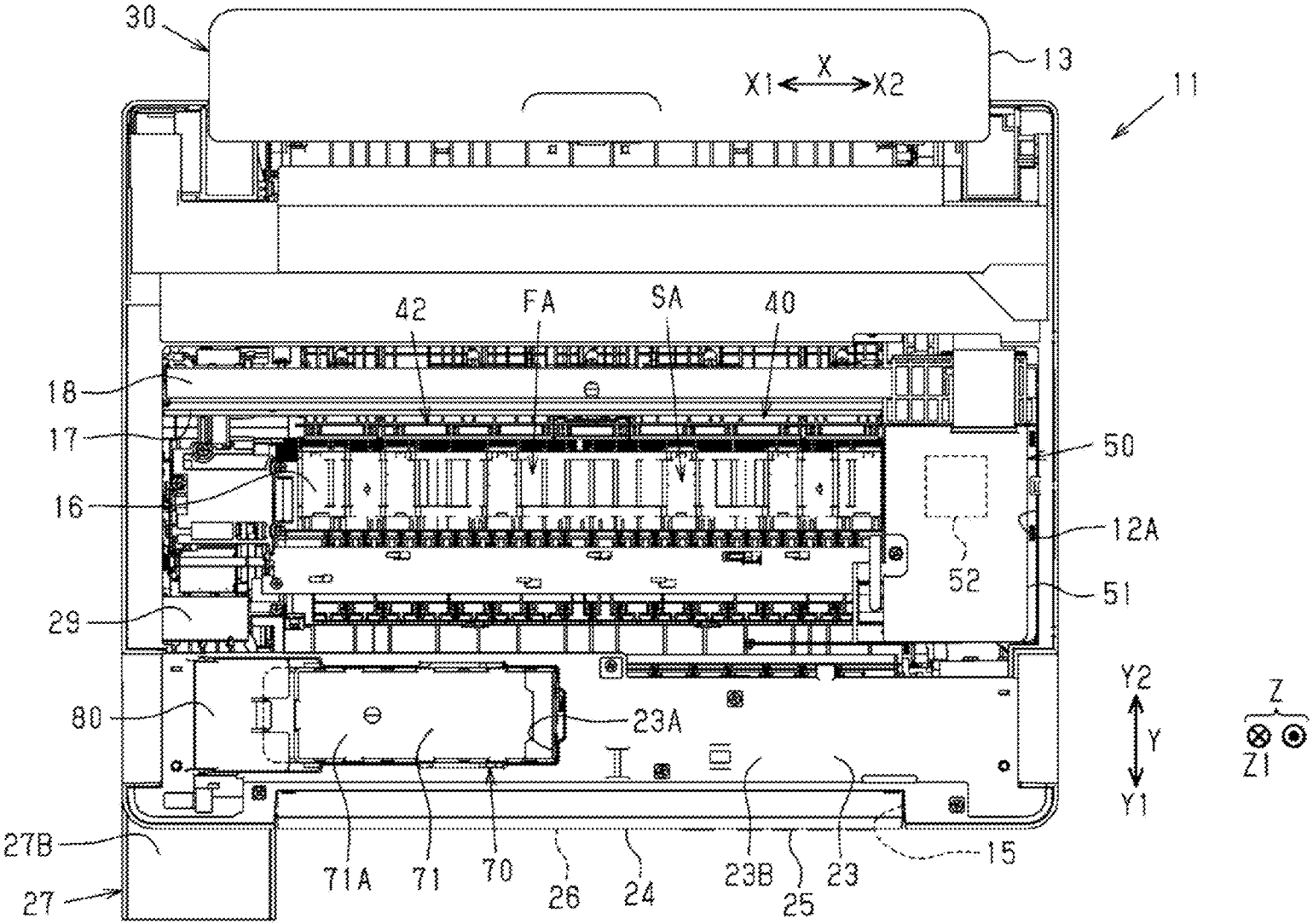
FIG. 2 is a plan view illustrating the liquid ejecting apparatus in a state in which a reading unit is open.
Figure 3:
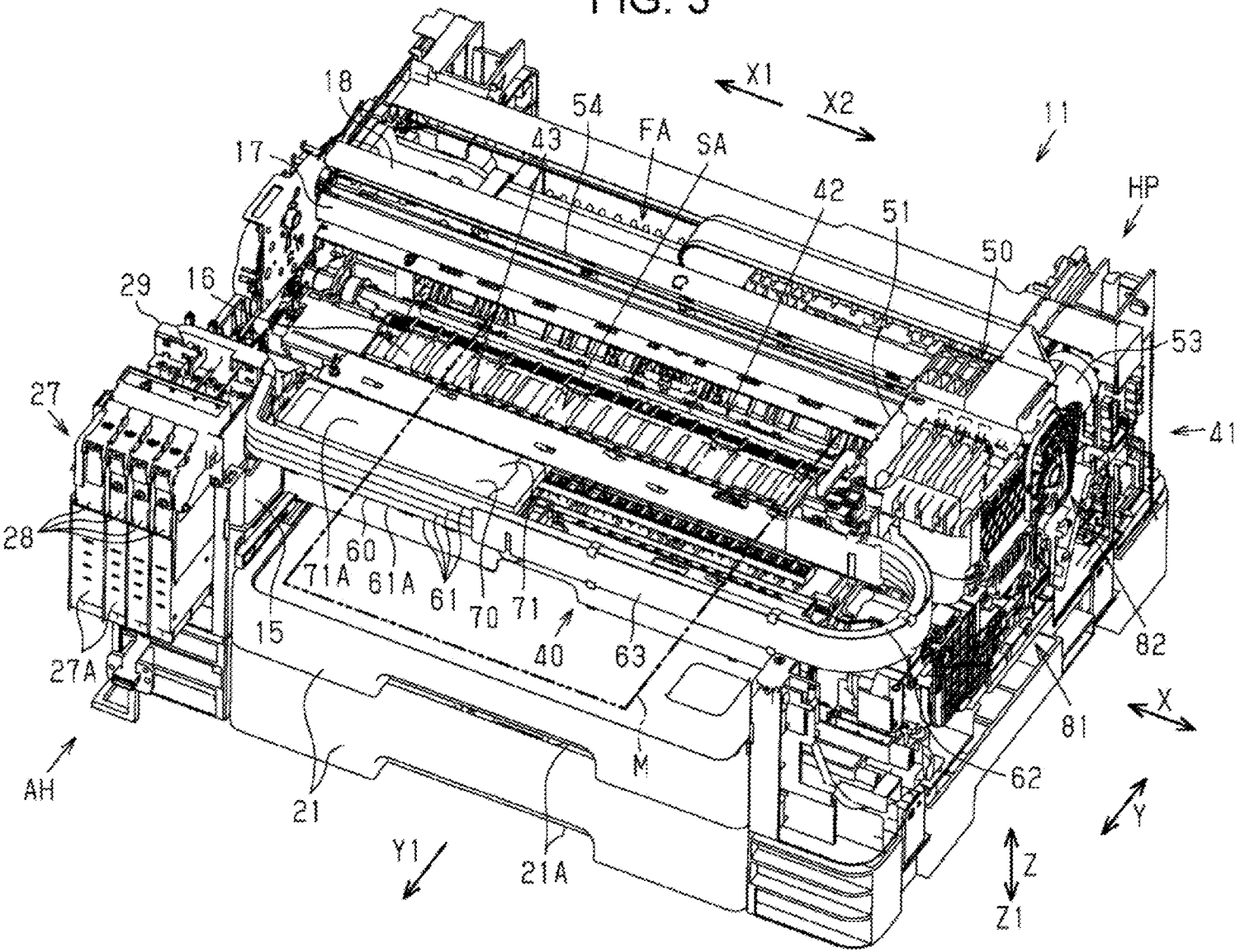
FIG. 3 is a perspective view illustrating the liquid ejecting apparatus in a state in which a housing is removed.

FIGS. 2 and 3 illustrate the liquid ejecting apparatus 11 in a state in which the reading unit 30 is opened. FIG. 3 illustrates the internal structure of the liquid ejecting apparatus 11 in a state in which the housing 12 is removed.

As illustrated in FIG. 2, in the state in which the reading unit 30 is opened, the carriage unit 50, a scanning region SA of the carriage unit 50, the waste liquid unit 70, and the like are exposed. Behind the space of the scanning region SA, a support table 16 is exposed on the base portion through the space. A long front member 23 which extends along the X-axis is disposed at a position opposing the reverse surface of the operation panel 24 inside the housing 12. The waste liquid unit 70 includes the waste liquid box 71 of an attaching/detaching system. The waste liquid box 71 is capable of storing the liquid eliminated from the liquid ejecting head 52 as a waste liquid. The waste liquid box 71 is mounted in a state in which a top end surface 71A thereof is exposed from an opening 23A of the front member 23. A top surface 23B of the front member 23 serves as a receiving surface which receives the reading unit 30 when the cover 13 is closed.

As illustrated in FIGS. 2 and 3, a width-center region inside the housing 12 serves as a transport region FA to which the medium M supplied from the cassettes 21 is to be transported. The liquid ejecting apparatus 11 is provided with a transport mechanism 40 responsible for the feeding of the medium M from the cassettes 21, the transporting of the fed medium M in the transport direction Y1, and the discharging of the medium M after the printing. The transport mechanism 40 includes a feeding section 41 which feeds the media M from the cassettes 21 to the rear portion of the liquid ejecting apparatus 11 one sheet at a time, a transport section 42 which transports the medium M in the transport direction Y1, and an discharge section 43 which discharges the medium M after the liquid is ejected and the printing is carried out. The transport section 42 transports the medium M fed by the feeding section 41 at a more upstream position in the transport direction Y1 than a printing region PA which faces the liquid ejecting head 52 during the scanning of the liquid ejecting head 52. The discharge section 43 discharges the medium M after the printing at a more downstream position in the transport direction Y1 than the printing region which faces the liquid ejecting head 52 during the scanning of the liquid ejecting head 52.

Figure 7:
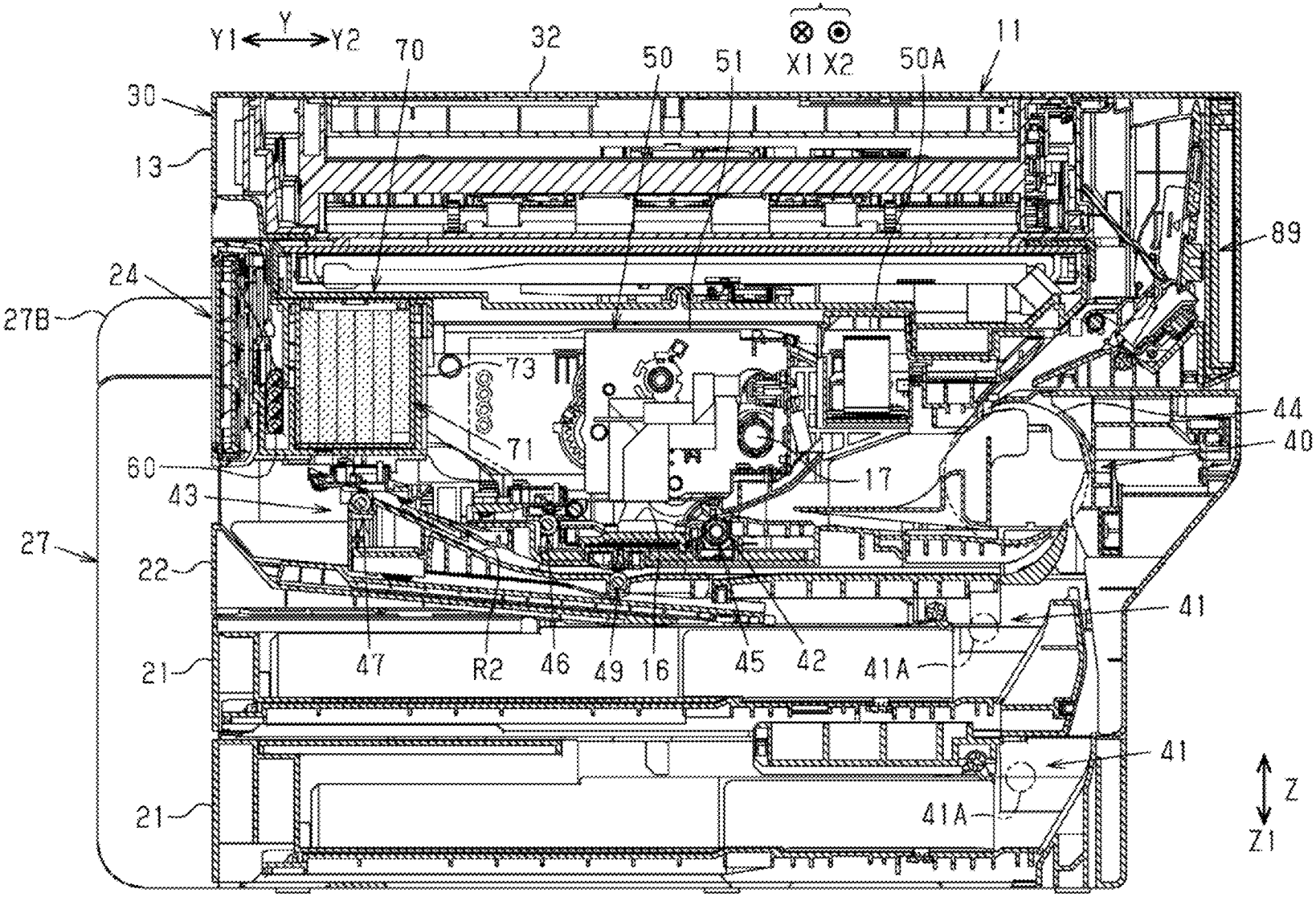
FIG. 7 is a side sectional diagram illustrating the liquid ejecting apparatus.

The feeding section 41 includes a pickup roller 41A which feeds out the topmost sheet of the media M stored in each of the cassettes 21 and an intermediate roller 44 which inverts the medium M that is fed out by transporting the medium M along the outer circumference of the intermediate roller 44 (refer to FIG. 7 for both the pickup roller 41A and the intermediate roller 44). The feeding section 41 inverts the medium M fed out to the rear from the cassettes 21 by the rotation of the pickup roller 41A along the outer circumference of the intermediate roller 44 and subsequently transports the medium M in the transport direction Y1. The support table 16 (described earlier) which supports the medium M that is a target on which the carriage unit 50 is to carry out printing is disposed in the transport region FA. The transport section 42 is provided with a transport roller pair 45 which transports the medium M in the transport direction Y1 along the transport path.

As illustrated in FIG. 2, the carriage unit 50 is supported to be capable of moving along the X-axis due to being guided by both a first guide member 17 and a second guide member 18. The carriage unit 50 reciprocally moves in the scanning directions X1 and X2 along both of the guide members 17 and 18.

As illustrated in FIG. 3, a carriage motor 53 which serves as a drive source of the carriage unit 50 is installed at the rear on one end portion of the movement path of the carriage unit 50 in the liquid ejecting apparatus 11. The drive force of the carriage motor 53 is transmitted to the carriage unit 50 via an endless timing belt 54. The timing belt 54 is wound around a pair of pulleys (not illustrated) and is provided to stretch along the first guide member 17 so as to extend along the X-axis. One of the pulleys is joined to the output shaft of the carriage motor 53. When the carriage motor 53 is driven forward, the carriage unit 50 moves out in the first scanning direction X1 and when the carriage motor 53 is driven backward, the carriage unit 50 moves back in the second scanning direction X2. The carriage 51 is capable of reciprocal movement in the scanning directions X1 and X2 that intersect the transport direction Y1.

In FIGS. 2 and 3, the carriage unit 50 is positioned at a home position HP (the home position) which is a waiting position at which the carriage unit 50 waits during non-printing times in which the printing is not performed on the medium M. As illustrated in FIG. 2, in the present example, the end portion in the second scanning direction X2 of the carriage unit 50 when the carriage unit 50 is at the end portion on the opposite side from the disposition position of the liquid supplying unit 27 serves as the home position HP. The position of the end portion which is the opposite side from the home position HP in the X-axis is an anti-home position AH of the carriage 51 (also refer to FIG. 7). When the medium M is printed on, the carriage 51 reciprocally moves in the printing region corresponding to the medium M inside the movable range between the home position HP and the anti-home position AH.

As illustrated in FIGS. 2 and 3, the liquid storage containers 28 are capable of storing the liquid to be supplied to the liquid ejecting head 52 (refer to FIG. 3) and are disposed at a separate position from the carriage 51. In the present example, the liquid storage containers 28 which supply the liquid to the carriage unit 50 are disposed on the end portion on the anti-home position AH side of the carriage unit 50 on the opposite side from the home position HP. The liquid ejecting apparatus 11 is provided with tubes 61 which are coupled to the carriage 51 and through which the liquid supplied from the liquid storage containers 28 to the liquid ejecting head 52 passes. The tubes 61 are formed of a synthetic resin material having flexibility, for example.

The liquid supplying unit 27 includes a mounting portion 29 including supply tubes (not illustrated) into which the liquid storage containers 28 are inserted. One end portion of the tubes 61 is coupled to the mounting portion 29, the tubes 61 are routed along the X-axis in a downstream region of the movement path of the carriage unit 50 in the transport direction Y1 and the other end portion of the tubes 61 is coupled to the carriage unit 50. The plurality of liquid storage containers 28 and the carriage 51 are coupled to each other by the plurality of corresponding tubes 61 in this manner. The plurality of tubes 61 is routed as a tube bundle 60 held in a state in which the tubes 61 line up in a row in the vertical direction Z1. The mounting portion 29 may be provided with a pump to supply the liquid from the liquid storage containers 28 to the carriage unit 50.

Here, when the carriage unit 50 reciprocally moves, a direction heading from the home position HP toward the anti-home position AH is the first scanning direction X1 and a direction heading from the anti-home position AH toward the home position HP is the second scanning direction X2. The tubes 61 extend from the mounting portion 29 to which the liquid storage containers 28 are mounted toward the second scanning direction X2 and subsequently form a curved portion 62 which curves accompanying a displacement toward the second transport direction Y2 which is a direction heading upstream in the transport direction Y1 of the medium M to double back in the first scanning direction X1 and be coupled to the carriage unit 50. After the tubes 61 extend in a predetermined path from the mounting portion 29 and are subsequently routed straight along the X-axis along the front portion inner surface of the housing 12, the tubes 61 include the U-shaped curved portion 62 in which the tubes 61 curve to double back accompanying a displacement from downstream to upstream in the transport direction Y1 at a portion in the middle of the entire length of the tubes 61. In this manner, the tubes 61 form the curved portion 62 which curves horizontally accompanying a displacement in the transport direction Y1.

A direction in which the liquid flows along the path of the tubes 61 inside the tubes 61 is a liquid supplying direction. The tubes 61 include a first linear portion 61A in which a portion upstream of the curved portion 62 in the liquid supplying direction extends substantially horizontally along the X-axis and a second linear portion 61B in which a portion downstream of the curved portion 62 in the liquid supplying direction extends substantially horizontally along the X-axis. The length of each of the first linear portion 61A and the second linear portion 61B changes due to the formation position of the curved portion 62 changing in accordance with the movement of the carriage unit 50. The plurality of tubes 61 which configure the tube bundle 60 is arranged in a row to overlap in the vertical direction Z1.

Figure 4:
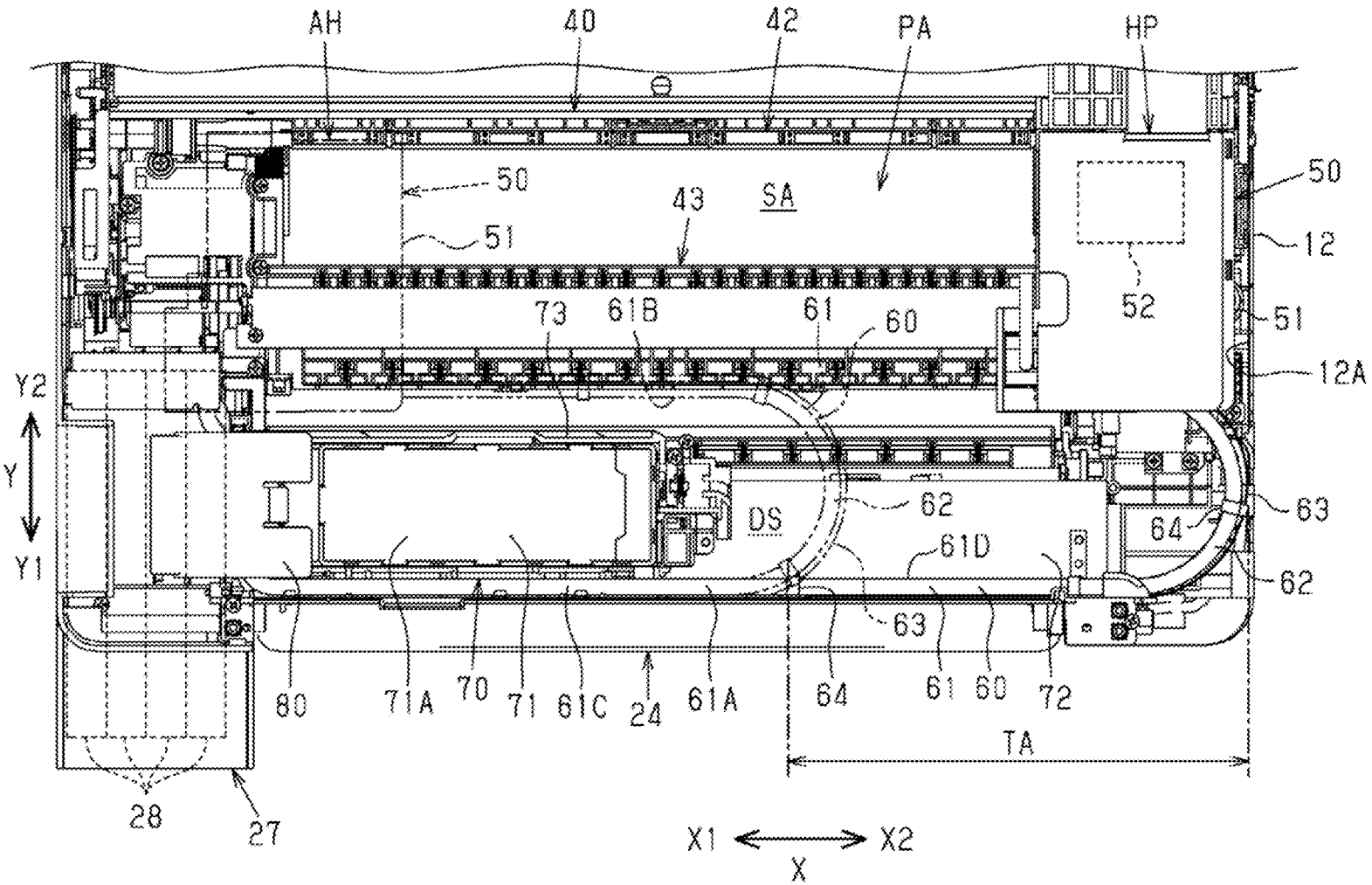
FIG. 4 is a plan view illustrating a carriage unit and a scanning region of the carriage unit.

As illustrated in FIG. 4, the tubes 61 include a fixed portion 61C which does not move even if the carriage 51 moves and a movable portion 61D which forms the curved portion 62 which moves in accordance with the movement of the carriage 51. Of the first linear portion 61A of the tubes 61, the fixed portion 61C which is not displaced by the movement of the carriage unit 50 is fixed to a holding member 72 which holds the waste liquid box 71. The holding member 72 includes a holding section 73 which holds the waste liquid box 71. The fixed portion 61C of the tubes 61 is routed by a path passing between the holding section 73 and the operation panel 24 along the X-axis.

Downward sagging of the tube bundle 60 caused by the weight of the tube bundle 60 itself is suppressed by the movable portion 61D which forms a more downstream portion in the liquid supplying direction than the fixed portion 61C in the longitudinal direction and is capable of being displaced being supported by a support member 63 formed of a film or a sheet that has flexibility. The support member 63 is attached so as to cover the surface on the side forming the outer circumferential surface of the curved portion 62 on the movable portion 61D. The support member 63 is attached to the movable portion 61D of the tube bundle 60 via a plurality of attachment members 64 attached leaving an interval along the longitudinal direction of the movable portion 61D.

In the present embodiment, the other end portion of the tubes 61 is coupled to the front end portion which serves as the downstream end portion of the carriage unit 50 in the transport direction Y1. Therefore, the first linear portion 61A of the tubes 61 and the carriage unit 50 are positioned to be distanced from each other by a predetermined distance in a range of approximately 1.5 times to 2 times the curvature radius of the curved portion 62 in the transport direction Y1. Accordingly, the movement region TA in which the curved portion 62 is capable of moving along the X-axis is secured in a region downstream of the movement path of the carriage unit 50 in the transport direction Y1.

The carriage unit 50 illustrated in FIG. 4 prints an image or a document onto the medium M by ejecting the liquid supplied from the liquid storage containers 28 through the tubes 61 toward the medium M from the liquid ejecting head 52 in the middle of reciprocally moving along the X-axis. In detail, the printing onto the medium M is carried out by alternately repeating a recording action in which one scan worth of the printing is carried out on the medium M by the liquid ejecting head 52 discharging the liquid in the process of the carriage unit 50 moving along the X-axis and a transporting action in which the transport section 42 and the discharge section 43 transport the medium M to the next printing position. The printed medium M is discharge from the discharge port 15 by the discharge section 43 and is stacked on the discharge tray 22 (refer to FIG. 1).

Figure 5:
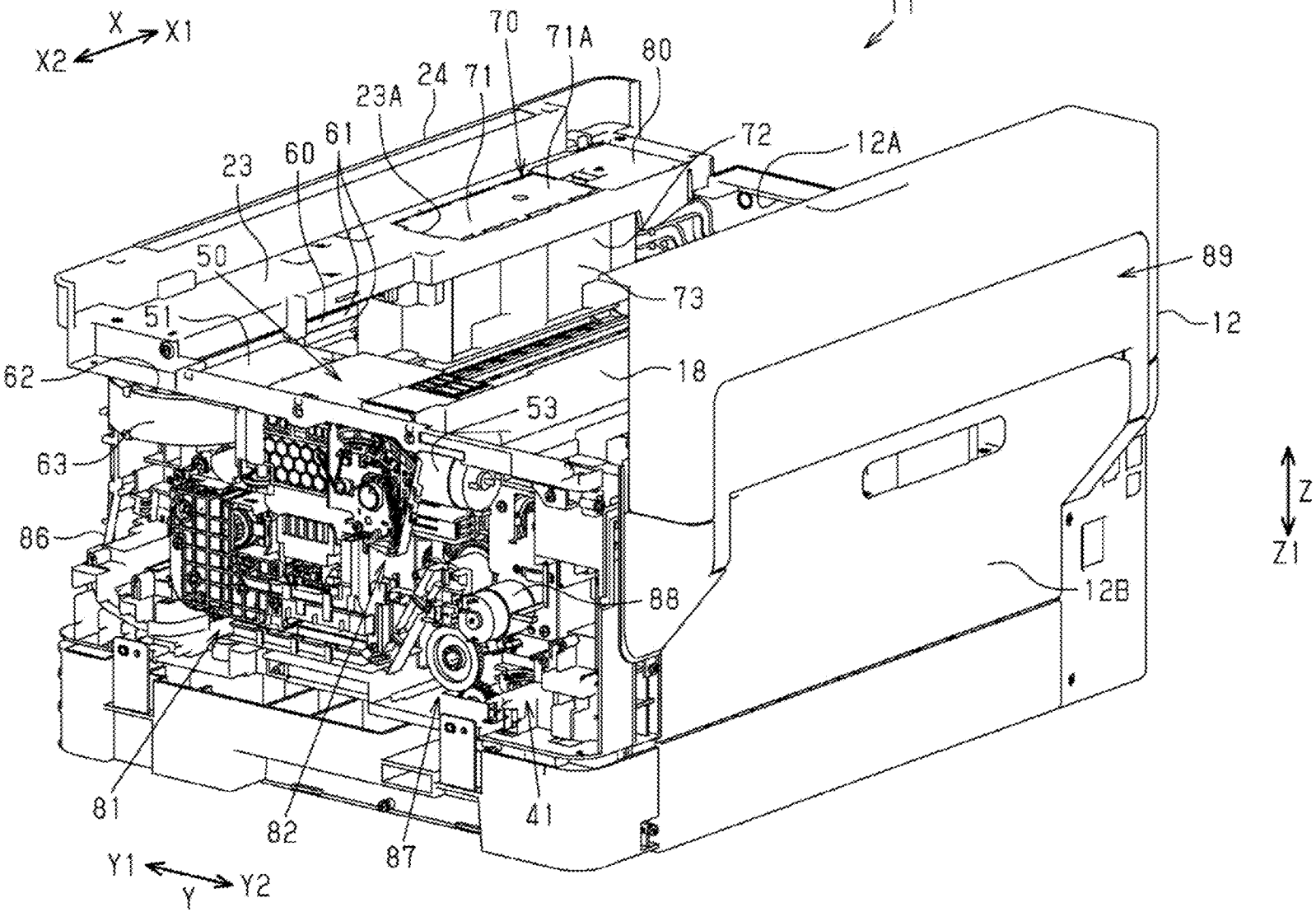
FIG. 5 is a perspective view illustrating the liquid ejecting apparatus in a state in which the housing is removed.

As illustrated in FIGS. 3 and 5, the liquid ejecting apparatus 11 is provided with a maintenance device 81 which performs maintenance on the liquid ejecting head 52 (refer to FIG. 6) at a maintenance position at which the carriage 51 is at one end portion of the movement path. The maintenance device 81 of the present example sets the home position HP to the maintenance position. The maintenance device 81 is disposed directly under the carriage unit 50 when positioned at the home position HP. The maintenance device 81 cleans nozzles 55 by forcefully eliminating a liquid such as an ink from the nozzles 55 (refer to FIG. 6) of the liquid ejecting head 52 in no relation to printing. In the present embodiment, although the disposition position of the maintenance device 81 is set to the home position HP, disposition position of the maintenance device 81 is not limited to the home position HP and may be a position deviated from the home position HP, may be the anti-home position AH, or may be a position deviated from the anti-home position AH.

In the nozzles 55 from which the liquid is not to be discharged during the printing, thickened ink in which the ink thickens inside the nozzles 55 causes nozzle clogging. There is a case in which foreign matter such as paper powder adhered to a nozzle opening surface 52A (refer to FIG. 6 of the liquid ejecting head 52 causes nozzle clogging. When bubbles are present in the ink inside the nozzles 55, this leads to mistakes in the discharging of the liquid in the liquid ejecting head 52. Therefore, when a predetermined time is elapsed from the previous cleaning, the maintenance device 81 is driven to carry out the cleaning of the nozzles 55 on the liquid ejecting head 52 in a state in which the liquid ejecting head 52 is positioned at the home position HP. In the liquid ejecting apparatus 11 provided with a nozzle fault detection device (not illustrated), when a nozzle fault is detected, the maintenance device 81 carries out the cleaning of the nozzles 55. Nozzle clogging and the like are prevented and alleviated by the cleaning.

As illustrated in FIG. 4, the holding section 73 is positioned close to one side which is the opposite side from the maintenance position in the movement directions of the carriage 51 inside the housing 12. In other words, the holding section 73 is close to one side that is the opposite side from the home position HP which is the maintenance position in a direction running along the width of the housing 12. The holding section 73 holds the waste liquid box 71 in an exposed state when the cover 13 is opened.

As illustrated in FIGS. 3 and 5, the liquid ejecting apparatus 11 is provided with a gap adjusting mechanism 82 which modifies the height position of the liquid ejecting head 52 with respect to the support table 16 to adjust a gap between the liquid ejecting head 52 and the medium M. The gap adjusting mechanism 82 adjusts the gap between the liquid ejecting head 52 and the support table 16 by causing the portion that supports the liquid ejecting head 52 to move along the Z-axis with respect to the portion that is supported by the guide member 18 in the carriage 51. The gap between the liquid ejecting head 52 and the medium M is adjusted to a suitable value corresponding to the type of the medium M due to the gap adjusting mechanism 82 being driven. The gap adjusting mechanism 82 may be configured to adjust the gap between the liquid ejecting head 52 and the support table 16 by causing the shaft-shaped guide member 17 to eccentrically pivot.

As illustrated in FIG. 5, a feeding mechanism 87 which feeds the medium M from the cassettes 21 on a plurality of levels is provided as a portion of the feeding section 41. The feeding mechanism 87 is provided with a feeding motor 88 which is the motive power source that drives the pickup roller 41A and a motive force transmission mechanism or the like which transmits the motive force of the feeding motor 88 to the pickup roller 41A. In the present embodiment, the holding section 73 and the waste liquid box 71 are disposed on the front portion of the housing 12 and the feeding mechanism 87 is disposed in the vacant space formed to the rear inside the housing 12.

As illustrated in FIG. 5, an opening/closing maintenance cover 12B and a manual operation feeding mechanism 89 are provided on the rear portion of the housing 12. The maintenance cover 12B which is opened when performing the work of alleviating jamming of the medium M that occurs in the feed path of the feeding section 41 and the feeding mechanism 89 is for feeding the medium M through the manual operation by a user.

As illustrated in FIG. 5, the waste liquid unit 70 is provided with the waste liquid box 71 (described earlier) which stores, as a waste liquid, the liquid that is discharged or eliminated from the liquid ejecting head 52 and is not used in the printing. Here, the waste liquid contains a liquid that is ejected during the flushing in which a liquid not related to the printing for refreshing the liquid inside the nozzles 55 is ejected by the liquid ejecting head 52 from the nozzles 55 and a liquid that is forcefully eliminated from the nozzles 55 (refer to FIG. 6) of the liquid ejecting head 52 during the cleaning. The waste liquid unit 70 is provided with the holding section 73 (described earlier) which holds the waste liquid box 71. The holding section 73 is formed integrally as a portion of the holding member 72.

As illustrated in FIG. 4, of the tubes 61 for supplying the liquid in the transport direction Y1, the holding section 73 is disposed between the fixed portion 61C and the scanning region SA of the carriage 51. In detail, when the carriage unit 50 is at the anti-home position AH, the holding section 73 is disposed between the first linear portion 61A and the second linear portion 61B of the tubes 61 for supplying the liquid in the transport direction Y1. The waste liquid box 71 held by the holding section 73 is positioned close to one side that is the opposite side from the maintenance position which is set to the home position HP in the movement directions of the carriage 51 inside the housing 12. In other words, the waste liquid box 71 is disposed at a position on the opposite side from the home position HP in a direction running along the X-axis inside the housing 12, that is, is disposed at a position close to the anti-home position AH. The holding section 73 is positioned close to one side which is the same side as the side on which the liquid storage containers 28 are disposed in the movement directions of the carriage 51 inside the housing 12. The holding section 73 is positioned on the same side as the side on which the liquid storage containers 28 are positioned in the direction running along the X-axis inside the housing 12.

As illustrated in FIG. 4, the curved portion 62 of the tubes 61 when the carriage 51 is at the home position HP is positioned at the end portion illustrated by a solid line in FIG. 2 in the movement path of the carriage 51. When the carriage 51 is at the anti-home position AH, the curved portion 62 is positioned in the vicinity of the center illustrated by the dashed line in FIG. 2 in the movement path of the carriage 51. In other words, when the carriage 51 reciprocally moves between the home position HP and the anti-home position AH, the curved portion 62 moves between an end portion position illustrated by the solid line in FIG. 2 and the center position illustrated by the double dot dashed line in FIG. 2. Inside the housing 12, the curved portion 62 moves in a range of the movement region TA inside the space which is formed between the first linear portion 61A of the tube bundle 60 and the scanning region SA of the carriage 51 in the transport direction Y1. In the space, the portion of the space outside of the movement region TA is a dead space DS which is not used for the movement of the curved portion 62.

As illustrated in FIG. 4, the holding member 72 includes the rectangular box-shaped holding section 73, which is open on the top, at a portion corresponding to the disposition region of the waste liquid box 71. The holding section 73 is positioned between the fixed portion 61C of the tubes 61 for supplying the liquid and the scanning region SA of the carriage unit 50 in the transport direction Y1. The holding section 73 is disposed on the outside of the movement region TA of the tubes 61. In detail, of the space between the portion at which the fixed portion 61C of the tubes 61 is positioned and the scanning region SA of the carriage 51, the space outside of the movement region TA of the tubes 61 is the dead space DS in which no portion of the tubes 61 is positioned in the movement process of the carriage unit 50. In the present embodiment, the holding section 73 and the waste liquid box 71 held by the holding section 73 are disposed using the dead space DS.

Figure 6:
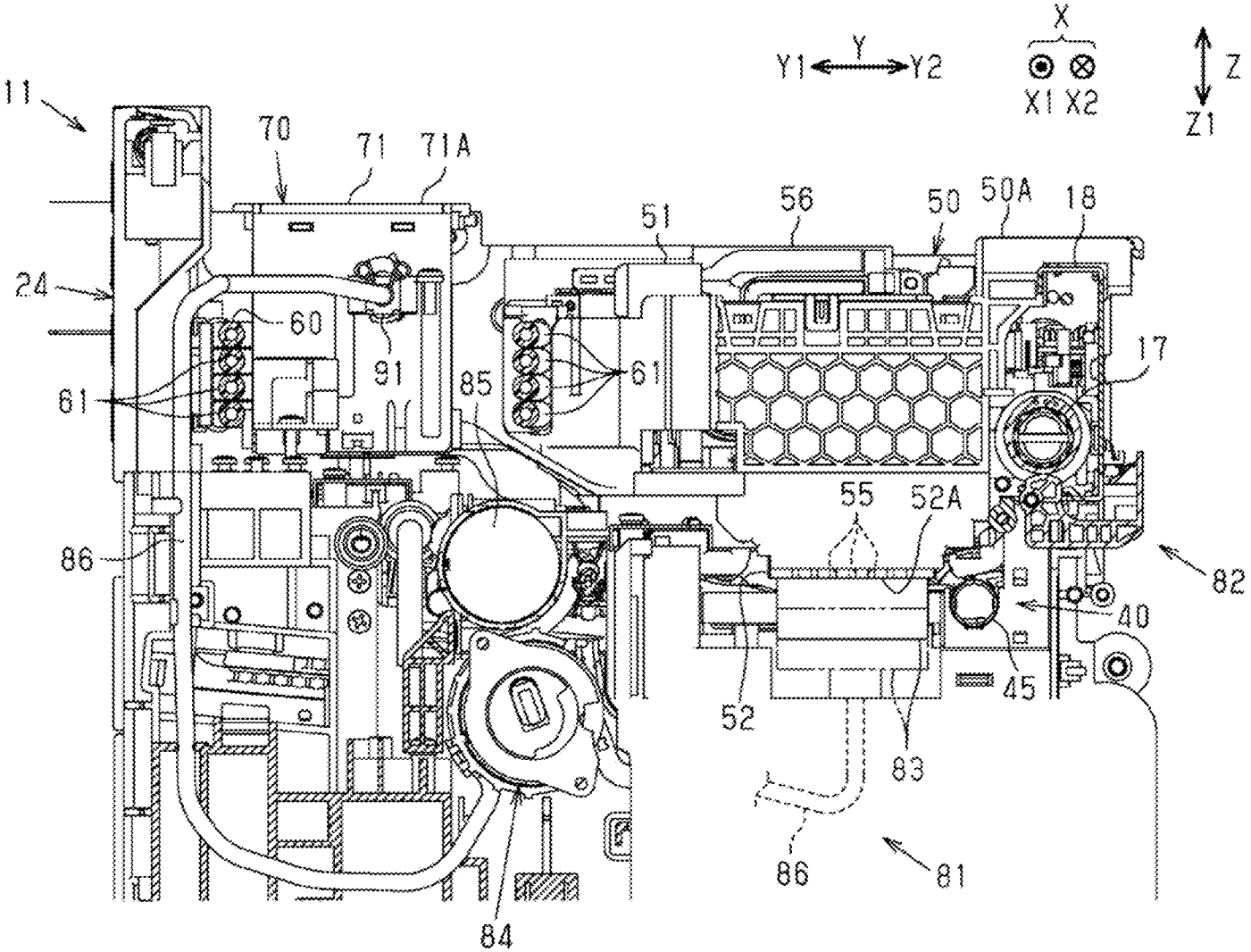
FIG. 6 is a side view illustrating the carriage unit and the periphery thereof as viewed from a home position side.

As illustrated in FIG. 6, the maintenance device 81 is provided with a cap 83 at a position facing the liquid ejecting head 52 when the carriage unit 50 is at the home position HP. The cap 83 is configured to be capable of rising and lowering along the Z-axis. The cap 83 moves between a capping position at which the nozzles 55 of the liquid ejecting head 52 are in contact with the nozzle opening surface 52A in which the nozzles 55 of the liquid ejecting head 52 are opened to form a closed space between the nozzle opening surface 52A and the cap 83 as illustrated by the solid line in FIG. 6 and a withdrawn position at which the cap 83 is separated from the nozzle opening surface 52A of the liquid ejecting head 52. The maintenance device 81 is provided with a suction pump 84 and an electric motor 85 which drives the suction pump 84. A waste liquid tube 86 which extends in a state in which one end portion of the waste liquid tube 86 is coupled to the bottom portion of the cap 83 is routed through a predetermined path inside the housing 12 via the suction pump 84 and the other end portion of the waste liquid tube 86 is coupled to a supply mechanism 91 fixed to the holding section 73. The waste liquid box 71 held by the holding section 73 is coupled to the waste liquid tube 86 via the supply mechanism 91.

Under the capped state illustrated in FIG. 6, the air is suctioned and eliminated from the space inside the cap 83 due to the suction pump 84 being driven by the driving force of the electric motor 85 and the liquid is forcefully suctioned and eliminated from the nozzles 55 of the liquid ejecting head 52 due to the closed space between the cap 83 and the nozzle opening surface 52A assuming a negative pressure. The thickened ink, the bubbles and the like inside the nozzles 55 are suctioned and eliminated to the inside of the cap 83 by the cleaning in which the liquid is forcefully eliminated from the nozzles 55. The liquid which is eliminated into the cap passes through the waste liquid tube 86 as the waste liquid from the maintenance device 81 and is collected in the waste liquid box 71 via the supply mechanism 91.

The flushing in which the liquid inside the nozzles 55 is refreshed is performed during the printing due to the carriage unit 50 periodically moving to the home position HP and ejecting droplets that are not related to the printing from all of the nozzles 55 of the liquid ejecting head 52. When greater than or equal to a predetermined amount of the liquid accumulates inside the cap 83 due to the flushing, the suction pump 84 is driven and the liquid inside the cap 83 is collected in the waste liquid box 71.

As illustrated in FIG. 7, the transport mechanism 40 is provided with the feeding section 41 including the pickup roller 41A in the vicinity of the end portion on the side at which the medium M of the cassettes 21 is fed. The transport mechanism 40 is provided with the intermediate roller 44 which receives and transports the medium M fed from the feeding section 41. The medium M transported via a portion of the outer circumference of the intermediate roller 44 is received by the transport section 42.

Figure 8:
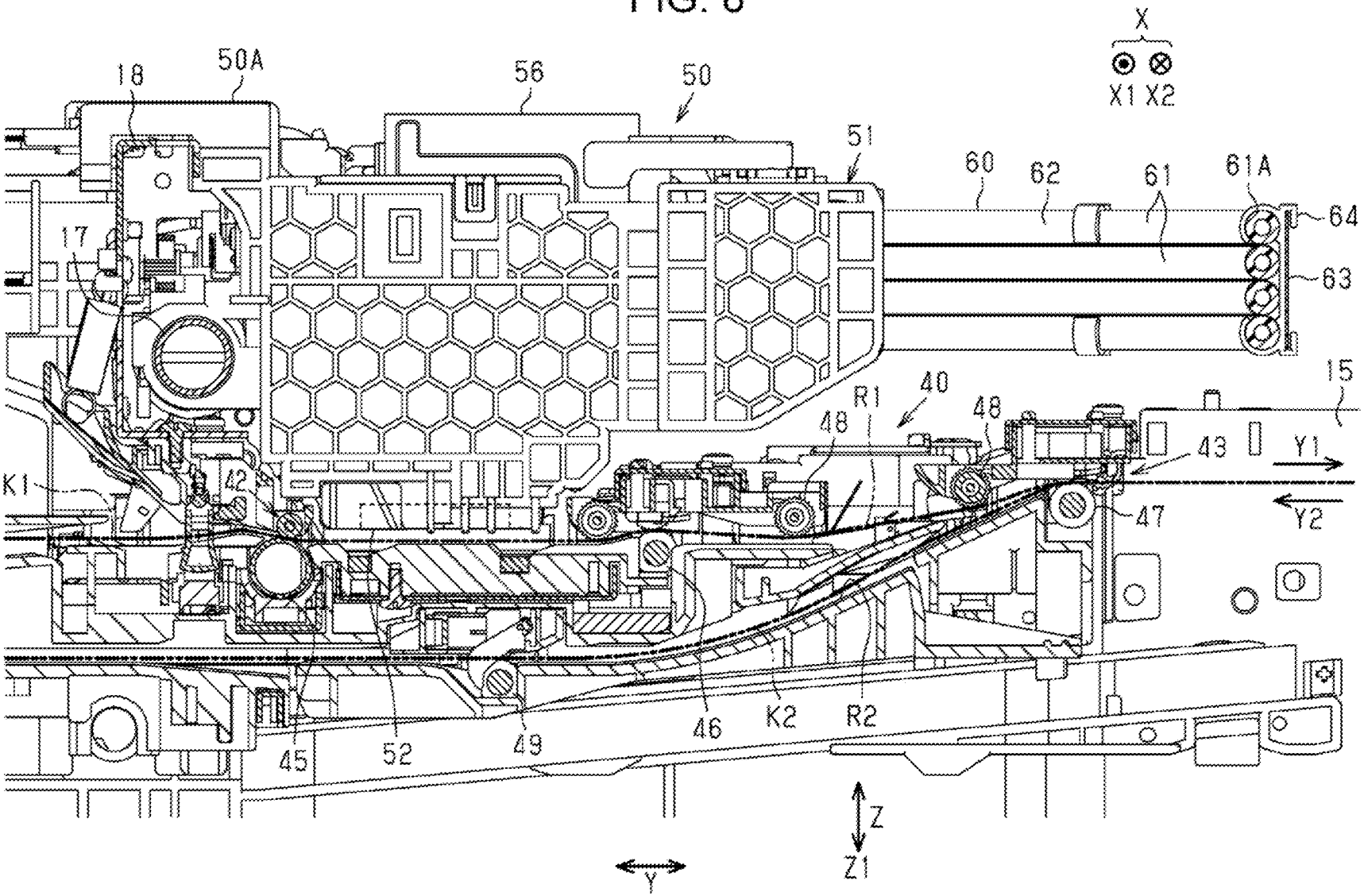
FIG. 8 is a side view illustrating the carriage unit and the periphery thereof as viewed from an anti-home position side.

As illustrated in FIGS. 7 and 8, the transport section 42 transports the medium M serving as the target onto which the liquid ejecting head 52 is to eject the liquid. The transport section 42 transports the medium M at a position upstream of the scanning region of the liquid ejecting head 52 in the transport direction Y1. The transport mechanism 40 is provided with a first transport path K1 in which the medium M is transported in the first transport direction Y1 during the printing and a second transport path K2 in which the medium M for which the printing of a first surface is completed is transported in the second transport direction Y2 which is the opposite direction from the first transport direction Y1 during duplex printing. In the transport mechanism 40, the second transport path K2 in which the medium M, after the printing in which the liquid is ejected, is transported in the second transport direction Y2 which is the opposite direction from the transport direction Y1 is included under the first transport path K1. The holding section 73 is positioned downstream of the scanning region SA of the carriage 51 and above the second transport path K2.

As illustrated in FIGS. 7 and 8, the discharge section 43 is provided with two roller pairs 46 and 47 disposed at different positions in the transport direction Y1. In detail, the discharge section 43 includes the first discharge roller pair 46 and the second discharge roller pair 47 disposed in order from upstream toward downstream in the first transport direction Y1 along the first transport path K1. In other words, the discharge section 43 includes the first discharge roller pair 46 disposed at a position downstream of the liquid ejecting head 52 in the transport direction Y1 and the second discharge roller pair 47 disposed at a position downstream of the first discharge roller pair 46 in the transport direction Y1. The holding section 73 is disposed at a position above the roller pair 47 which is one of the two roller pairs 46 and 47 that is positioned downstream in the transport direction Y1.

As illustrated in FIG. 8, the transport roller pair 45 is disposed at a position upstream of the scanning region of the liquid ejecting head 52 in the transport direction Y1. The first discharge roller pair 46 and the second discharge roller pair 47 are disposed at positions downstream of the scanning region of the liquid ejecting head 52 in the transport direction Y1. The second discharge roller pair 47 is positioned downstream of the first discharge roller pair 46 in the transport direction Y1. The roller pairs 45 to 47 are driven by the motive force of one or a plurality of transport motors (not illustrated). The two discharge roller pairs 46 and 47 are driven together with the transport roller pair 45 and perform the transporting of the medium M during the printing and the discharging of the medium M once the printing is finished. One or more floating rollers 48 which guide the medium M along the first transport path K1 is provided at a position along the first transport path K1. The tube bundle 60 is routed in a state in which the curved portion 62 is positioned above the second discharge roller pair 47.

As illustrated in FIG. 8, the coupling location between the first transport path K1 and the second transport path K2 is provided between the first discharge roller pair 46 and the second discharge roller pair 47. In detail, the coupling location between the first transport path K1 and the second transport path K2 is positioned slightly upstream of the nipping position of the second discharge roller pair 47 in the first transport direction Y1. The coupling location is the entrance of the medium M which is guided to the second transport path K2. In the medium M in which the printing is performed on the first surface when performing the duplex printing, when the medium M is discharge to the middle of the first transport direction Y1 by the discharge roller pairs 46 and 47 and the rear end of the medium M passes the entrance of the second transport path K2, switch-back transporting is performed by inverting the rotation of the second discharge roller pair 47 and the medium M being transported in reverse in the second transport direction Y2. As a result of the switch-back transporting, the medium M is guided to the second transport path K2 and is transported along the second transport path K2 in the second transport direction Y2. An inverting roller pair 49 is provided at a position along the second transport path K2. After the medium M passes through the second transport path K2 and is transported upstream by the inverting roller pair 49, the medium M is inverted via the outer circumference of the intermediate roller 44 (refer to FIG. 7). The inverted medium M is re-fed toward the printing position oriented such that the second surface which is the opposite surface from the printed first surface is capable of facing the liquid ejecting head 52.

As illustrated in FIG. 8, in the liquid ejecting apparatus 11 of the present embodiment, both pairs of the first discharge roller pair 46 and the second discharge roller pair 47 are disposed downstream of the liquid ejecting head 52 in the transport direction Y1. Therefore, as compared to a configuration in which only one of the discharge roller pairs is disposed, a space that is wide in the transport direction Y1 is secured in a downstream region of the scanning region SA of the carriage unit 50. This wide space is used as a routing space of the tubes 61. The tubes 61 are routed such that the curved portion 62 is positioned above the second discharge roller pair 47. The distal end portions which are the downstream end portions of the tubes 61 in the liquid supplying direction are coupled to the downstream end portion of the carriage 51 in the transport direction Y1. The other end portions of the plurality of tubes 61 communicate with a respective plurality of liquid storage bodies 56 installed on the top portion of the carriage 51 after being coupled to the carriage 51. The liquid transported through the plurality of tubes 61 is temporarily stored in the plurality of liquid storage bodies 56, subsequently supplied to the liquid ejecting head 52, and ejected from the nozzles 55.

Figure 9:
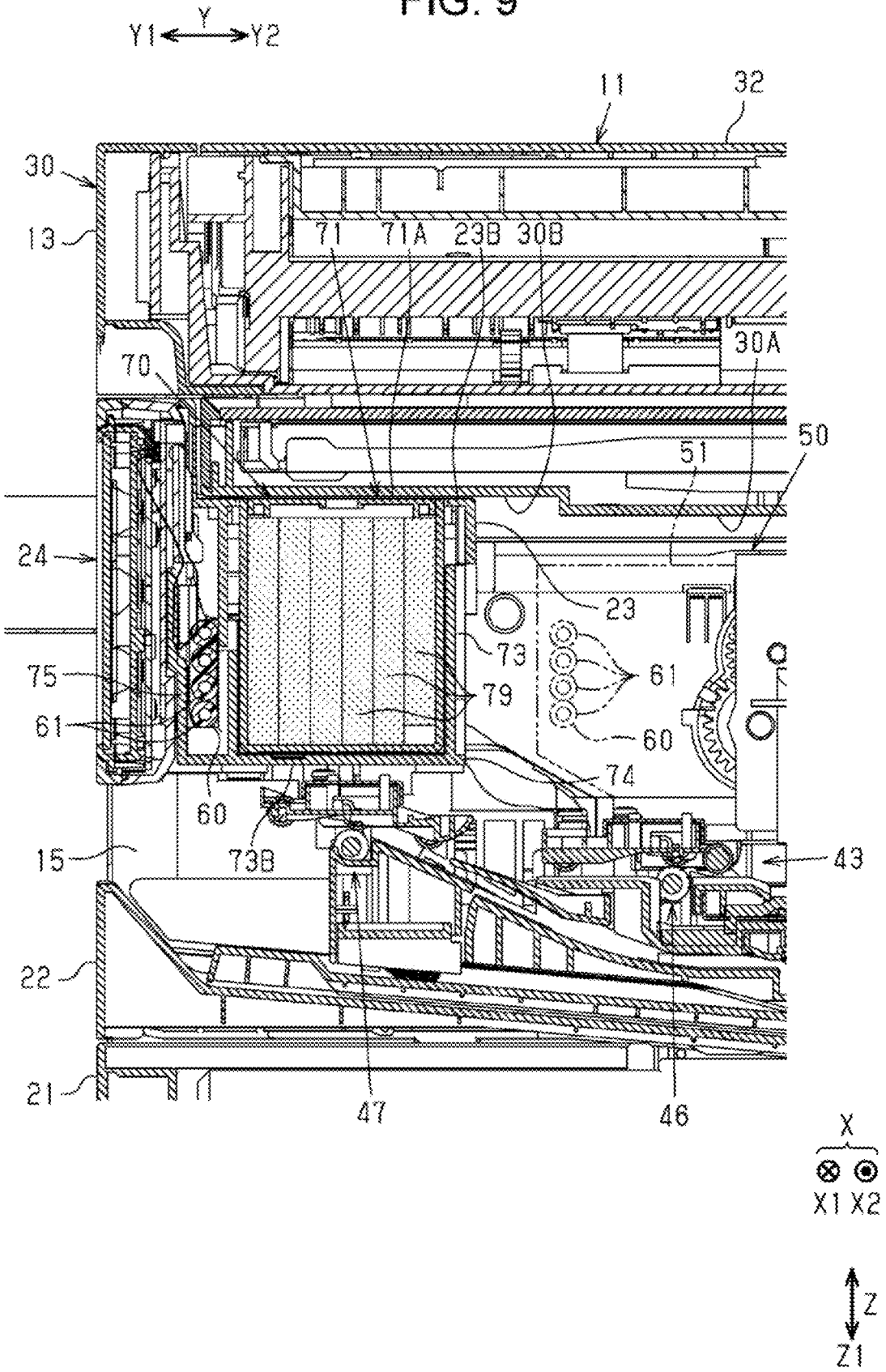
FIG. 9 is a side sectional diagram illustrating a front portion of the liquid ejecting apparatus.

As illustrated in FIG. 7, in the liquid ejecting apparatus 11 of the present embodiment, of the space positioned above the second discharge roller pair 47, the dead space DS (refer to FIG. 4) which is not used as the movement region TA of the curved portion 62 is used as the disposition space of the holding section 73. As illustrated in FIGS. 7 and 9, the holding section 73 is positioned downstream of the carriage 51 in the transport direction Y1 and is positioned above the discharge section 43. In the present example, the holding section 73 is positioned above the second discharge roller pair 47. The holding section 73 is disposed above (refer to FIG. 7) the transport paths K1 and K2 (refer to FIG. 8) in which the transport mechanism 40 transports the medium M and is disposed downstream (refer to FIG. 4) of the scanning region SA of the carriage 51 in the transport direction Y1. In this manner, the waste liquid unit 70 including the holding section 73 and the waste liquid box 71 is disposed above the second discharge roller pair 47. The holding section 73 is stored in the housing 12 together with the liquid ejecting head 52 and the like. The holding section 73 is disposed above the discharge port 15 formed for discharging the medium M in the housing 12.

Here, as illustrated in FIG. 8, a first transport route R1 is configured by the intermediate roller 44, the roller pairs 45 to 47, the medium guide member, and the like positioned along the first transport path K1 inside the housing 12. The path when the medium M is transported along the first transport route R1 is the first transport path K1. The first transport route R1 is a transport route of a range in which the intermediate roller 44 and the roller pairs 45 to 47 are present and the second discharge roller pair is positioned on the downstream end of the first transport route R1 in the transport direction Y1. A second transport route R2 is configured by the roller pairs 47, 49, the medium guide member, and the like positioned along the second transport path K2 in the housing 12. The path when the medium M is transported along the second transport route R2 is the second transport path K2. The second transport route R2 is a transport route of a range in which the roller pairs 47 and 49 are present and the second discharge roller pair is positioned on the downstream end of the second transport route R2 in the transport direction Y1. The first transport route R1 and the second transport route R2 are coupled at the nipping position of the second discharge roller pair. The holding section 73 being positioned above the second transport path K2 is synonymous with the holding section 73 being positioned above the second transport route R2. The region in which the holding section 73 is positioned above the first transport path K1 is wider in a downstream region in the transport direction Y1 than the region in which the holding section 73 is positioned above the second transport route R2.

Next, a description will be given of the state of the disposition of the tubes 61 in the movement process of the carriage unit 50 with reference to FIG. 4. As illustrated in FIG. 4, as the carriage unit 50 moves in the first scanning direction X1 or the second scanning direction X2, the curved portion 62 of the tubes 61 moves in the same direction as the carriage unit 50 by a movement amount that is approximately half of the movement amount of the carriage unit 50.

As illustrated in FIG. 4, the carriage unit 50 waits at the home position HP which is the one end portion on the movement path when the liquid is not to be ejected onto the medium M and approaches the curved portion 62 most when at the home position HP. As illustrated in FIG. 4, when the carriage unit 50 moves to the first scanning direction X1 distancing from the home position HP and the carriage 51 is at the anti-home position AH illustrated by the double dot dashed line in FIG. 4, the carriage unit 50 is most distanced from the curved portion 62.

The waste liquid box 71 is disposed between the fixed portion 61C of the tubes 61 and the scanning region SA of the carriage unit 50. In the movement process of the carriage unit 50, when the curved portion 62 is positioned at a position illustrated by the solid line in FIG. 4 at the time at which the carriage unit 50 is at the home position HP and when the curved portion 62 is positioned in the vicinity of the width center inside the housing 12 illustrated by the double dot dashed line in FIG. 4 at the time at which the carriage unit 50 is at the anti-home position AH, the curved portion 62 does not come into contact with the holding section 73.

Figure 11:
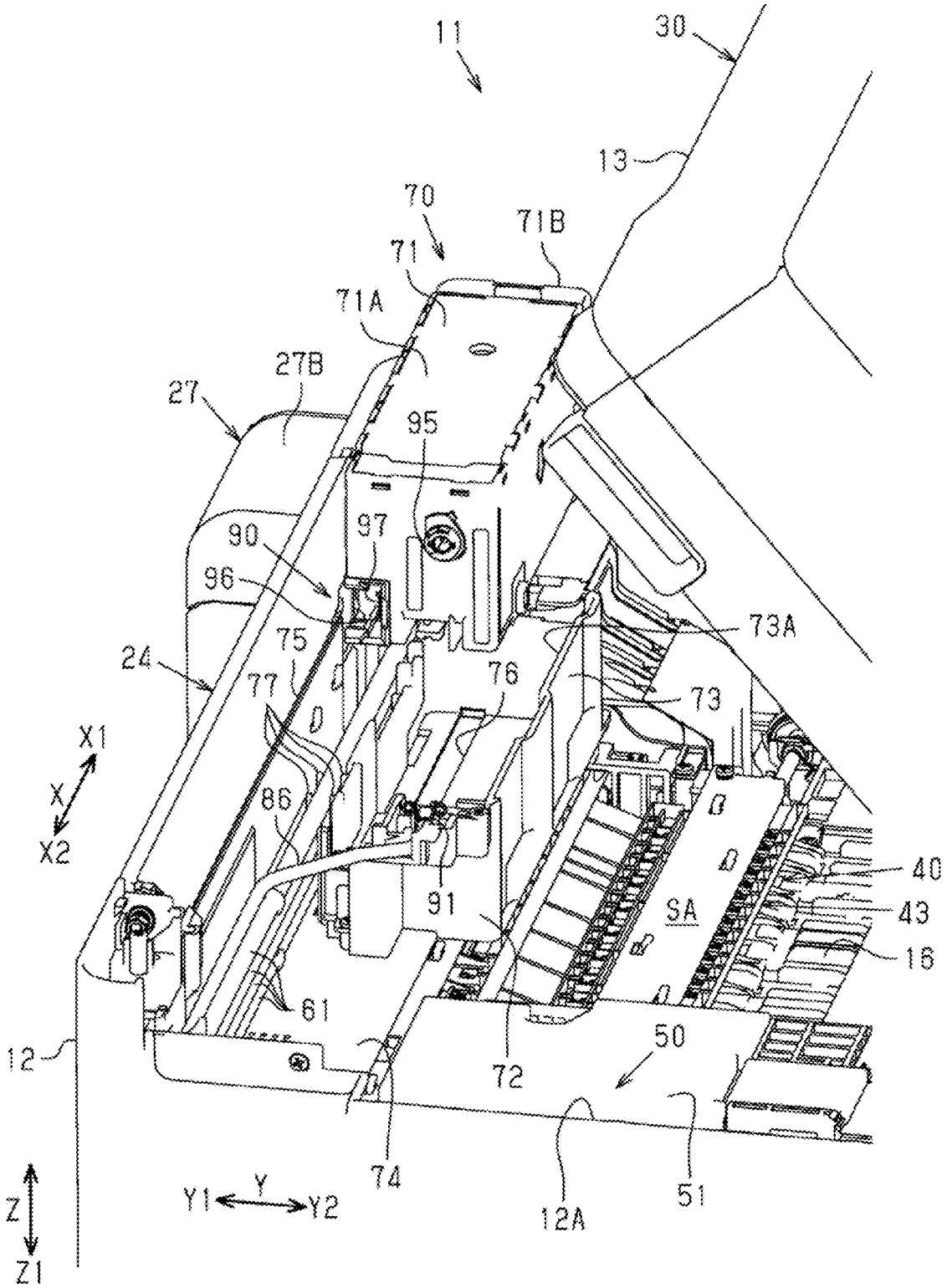
FIG. 11 is a perspective view illustrating the liquid ejecting apparatus in a state in which a waste liquid box is removed from a holding member.
Figure 12:
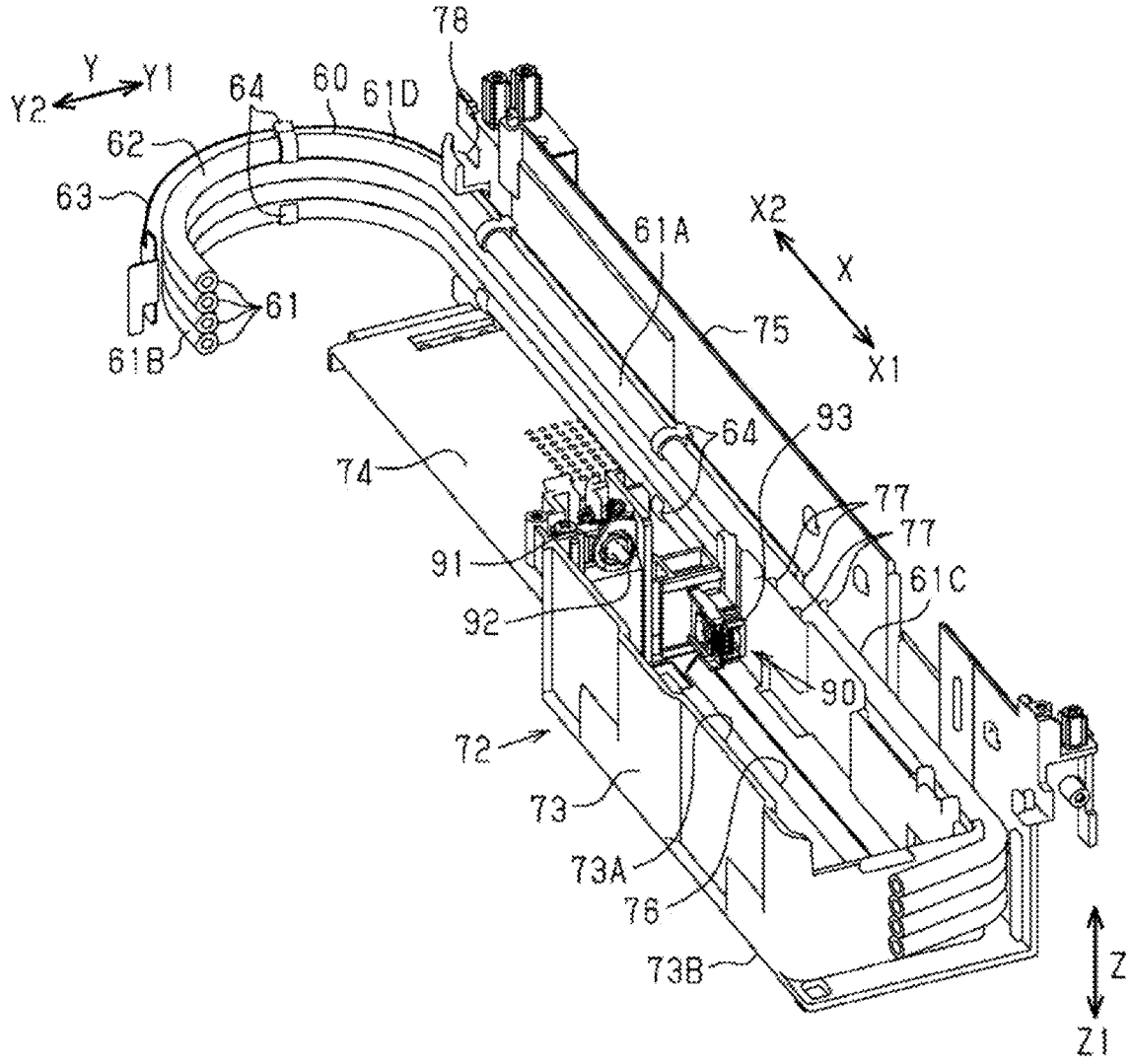
FIG. 12 is a perspective view illustrating the holding member and a tube.

Next, a description will be given of the holding member 72 and the waste liquid box 71 with reference to FIGS. 6 to 12. As illustrated in FIGS. 11 and 12, the holding member 72 includes a base plate portion 74, a side plate portion 75 which stands perpendicular to the base plate portion 74 from the downstream end in the transport direction Y1, and the box-shaped holding section 73 (described earlier) which is disposed leaving a predetermined gap to the side plate portion in the transport direction Y1 at a portion above the base plate portion 74. The holding section 73 is disposed at a position close to one side in a direction along the X-axis on the base plate portion 74. The space between the holding section 73 and the side plate portion 75 is a holding space in which the plurality of tubes 61 configuring the tube bundle 60 are held in a vertically-oriented state lined up in the vertical direction Z1. The surface on the opposite side from the holding section 73 in the side plate portion 75 is an assembly target surface onto which the operation panel 24 is assembled in a state of being capable of pivoting.

Next, a description will be given of the positional relationship of the heights between the tube bundle 60 and the holding member 72 and the waste liquid box 71 with reference to FIGS. 6, 7, 9, and 10. As illustrated in FIGS. 6, 7, 9, and 10, the bottom end of the holding section 73 is positioned directly under the tubes 61. In other words, a base surface 73B which is the bottom end of the holding section 73 which holds the waste liquid box 71 is positioned below the bottom end of the tube bundle 60 in the vertical direction Z1. The top end surface 71A of the waste liquid box 71 held by the holding section 73 is exposed from the opening 23A of the front member 23 and is positioned at approximately the same height as the top surface 23B. The top end surface 71A of the waste liquid box 71 is positioned above the top end of the tube bundle 60 in the vertical direction Z1. The top end surface 71A of the waste liquid box 71 is positioned still higher than a top end surface 50A of the carriage unit 50 which is positioned higher than the top end of the tube bundle 60. Therefore, it is possible to lengthen the height dimension of the waste liquid box 71 capable of being stored inside the housing 12.

As illustrated in FIG. 9, the top end surface 71A of the waste liquid box 71 held by the holding section 73 is a flat surface and is exposed substantially flush with the top surface 23B of the front member 23. When the cover 13 of the reading unit 30 is closed, the top surface 23B of the front member 23 serves as a receiving surface which receives a base surface 30A of the reading unit 30. The base surface 30A of the reading unit 30 includes a level difference portion 30B. A portion of the reading unit 30 corresponding to the exposed surface of the waste liquid box 71 and the top surface 23B in a state in which the cover 13 is closed is recessed upward. It is possible to secure a longer height dimension of the waste liquid box 71 capable of being stored inside the housing 12 by an amount corresponding to the height of the level difference portion 30B. This leads to an increase in the waste liquid storage volume of the waste liquid box 71. A recessed portion may be provided in the base surface 30A of the cover 13 instead of the level difference portion 30B.

As illustrated in FIGS. 11 and 12, the supply mechanism 91 is attached to one end portion of the holding section 73. The supply mechanism 91 is provided with the supply needle 92 which serves as the coupling portion provided on the other end portion of the waste liquid tube 86 (refer to FIG. 11). The supply needle 92 is disposed at a height position distanced upward from the top surface of the base plate portion 74 by a predetermined distance which is longer than the height dimension of the tube bundle 60. In this manner, the holding section 73 includes the supply needle 92 provided on one end of the waste liquid tube 86 which extends from the maintenance device 81. The holding section 73 includes a supply needle 92 which couples the waste liquid box 71 to the waste liquid tube 86. A first locking mechanism 93 is provided on one end portion of the same side as the supply mechanism 91 inside the holding section 73.

As illustrated in FIGS. 11 and 12, the holding section 73 is provided with an attaching/detaching mechanism 90 which attaches and detaches the waste liquid box 71 with respect to the holding section 73 such that it is possible to couple and remove the waste liquid box 71 with respect to the supply needle 92 by sliding the waste liquid box 71 in the scanning directions X1 and X2 which are the movement directions of the carriage 51. A guide groove 76 which engages with a guide portion (not illustrated) of the base portion of the waste liquid box 71 to guide the waste liquid box 71 along the X-axis in a slidable manner is formed in the base surface of the holding section 73.

A plurality of pairs of ribs 77 is provided along the X-axis on both mutually-facing surfaces of the holding section 73 and the side plate portion 75. The fixed portion 61C of the plurality of tubes 61 is held by the holding member 72 in the path that passes between the holding section 73 and the side plate portion 75 due to the fixed portion 61C being pinched by the ribs 77 at a plurality of locations. The tube bundle 60 is routed at a height slightly above the base plate portion 74. When the tube bundle 60 sags, further sagging is suppressed by the bottom end of the tube bundle 60 coming into contact with the base plate portion 74. The waste liquid tube 86 coming out from the supply needle 92 configuring the supply mechanism 91 is routed along the tubes 61 at a position above the movable portion 61D of the tube bundle 60.

Figure 10:
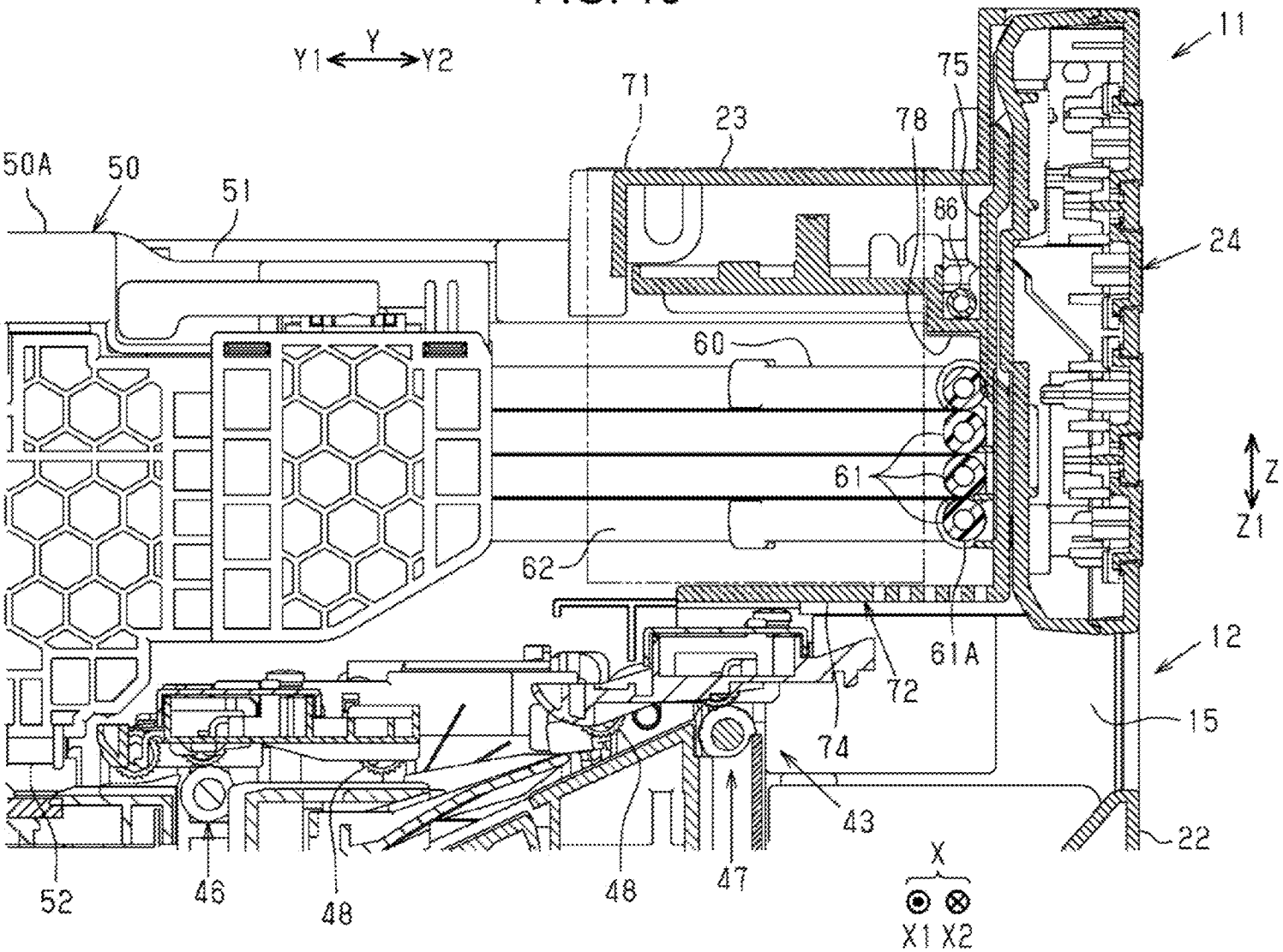
FIG. 10 is a side sectional view illustrating the carriage unit and the periphery thereof as viewed from the anti-home position side.

As illustrated in FIG. 10, the liquid ejecting apparatus 11 includes a partitioning wall portion 78 which separates the tubes 61 which supply the liquid from the liquid storage containers 28 and the waste liquid tube 86 from each other. In detail, as illustrated in FIGS. 10 and 12, the partitioning wall portion 78 which vertically partitions the tube bundle 60 and the waste liquid tube 86 is provided to protrude on the side plate portion 75 on one end portion which serves as the opposite side from the side at which the holding section 73 is positioned in the longitudinal direction of the holding member 72. The partitioning wall portion 78 is positioned at approximately the same height as the supply needle 92 assembled onto the holding section 73. The waste liquid tube 86 is positioned above the tube bundle 60 by being routed to rest on the top of the partitioning wall portion 78.

The waste liquid box 71 has a rectangular parallelepiped shape and a box-shaped handle portion 71B extends parallel to the top end surface 71A on one end of the top portion of the waste liquid box 71. The waste liquid box 71 includes a supply port portion 95 as an example of a coupling target portion which is coupled to the supply needle 92 of the holding section 73 side. In detail, the supply port portion 95 punctured by the supply needle 92 is provided on one end surface which is on the opposite side from the handle portion 71B in the longitudinal direction of the waste liquid box 71. The waste liquid box 71 is coupled to the waste liquid tube 86 due to the supply needle 92 puncturing the supply port portion 95. Therefore, the waste liquid which is fed to the waste liquid box 71 through the waste liquid tube 86 does not leak from the coupling location. A second locking mechanism 96 is provided on the end surface bottom portion of the waste liquid box 71. When the waste liquid box 71 is caused to slide along the X-axis, the position of the waste liquid box 71 is restricted to the coupling position at which the supply needle 92 punctures the supply port portion 95 due to the first locking mechanism 93 and the second locking mechanism 96 being locked together. Therefore, the coupling between the waste liquid box 71 and the supply needle 92 will not be released by the vibration of the liquid ejecting apparatus 11 or the like.

As illustrated in FIGS. 11 and 12, in the present embodiment, the attaching/detaching mechanism 90 is configured by the first locking mechanism 93, the second locking mechanism 96, the guide groove 76, and the like. The attaching/detaching mechanism 90 is removed by the user sliding the waste liquid box 71 in a removal direction which is the direction of the opposite side from the side on which the curved portion 62 is positioned in the movement directions of the carriage 51. When the user pulls the waste liquid box 71 horizontally in the removal direction, the locking between the first locking mechanism 93 and the second locking mechanism 96 is released and the waste liquid box 71 is horizontally guided along the guide groove 76 until the supply needle 92 and the supply port portion 95 are separated from each other.

A first terminal (not illustrated) is provided on the first locking mechanism 93 and a second terminal (not illustrated) is provided on the second locking mechanism 96. When the waste liquid box 71 is set in the holding section 73 and the first locking mechanism 93 and the second locking mechanism 96 are locked together, the first terminal and the second terminal are electrically coupled to each other. A memory element 97 is provided in the waste liquid box 71 in the vicinity of the second locking mechanism 96. The control section 100 is capable of accessing the memory element 97 to perform reading and writing of data in a state in which the waste liquid box 71 is set in the holding section 73. Data relating to the waste liquid amount collected by the waste liquid box 71 is written onto the memory element 97.

The control section 100 illustrated in FIG. 1 embedded in the liquid ejecting apparatus 11 controls the carriage motor 53, the liquid ejecting head 52, the transport motors, and the like. The liquid ejecting apparatus 11 is coupled to a host device (not illustrated) to be capable of communication therewith. The control section 100 performs printing control based on print data received from the host device. The host device is configured by one of a personal computer, a portable information terminal (a personal digital assistant (PDA)), a tablet PC, a smartphone, a mobile telephone, or the like, for example. The control section 100 acquires the waste liquid amount of the waste liquid box 71 by measuring the amount of the liquid that is ejected or eliminated from the liquid ejecting head 52 for the purpose of maintenance and adding the measured liquid amount to a liquid amount read from the memory element 97. The control section 100 performs updating by regularly or irregularly writing the most recent liquid amount of the waste liquid box 71 to the memory element 97. When the waste liquid amount of the waste liquid box 71 reaches an upper limit value, the control section 100 performs notification by causing a message to the effect of an exchanging period and to the effect of urging the user to perform the exchanging on the display section 26 or a display section of the host device.

Next, a description will be given of the actions of the liquid ejecting apparatus 11.

When the liquid ejecting apparatus 11 receives a printing instruction, the feeding section 41 is driven and the medium M fed from the cassettes 21 is transported in the transport region FA in the transport direction Y1. The printing onto the medium M progressed due to the alternate performing of a printing action in which the liquid ejecting head 52 ejects the liquid toward the medium M while the carriage unit 50 is in the middle of moving in the first scanning direction X1 or the second scanning direction X2 to perform one scan worth of the printing and a transporting action in which the medium M is transported to the next printing position by the roller pairs 45 to 47.

As illustrated in FIG. 4, as the carriage unit 50 moves in the first scanning direction X1 or the second scanning direction X2, the curved portion 62 of the tubes 61 moves in the same direction as the carriage unit 50 by a movement amount of approximately half of the movement amount of the carriage unit 50. During the printing, the carriage unit 50 periodically moves to the home position HP, performs the flushing in which the liquid that is unrelated to the printing is discharged from all of the nozzles 55 of the liquid ejecting head 52 and refreshes the liquid inside the nozzles 55. Every time the flushing is performed in this manner, the liquid from the nozzles 55 of the liquid ejecting head 52 is ejected toward the cap 83. Due to the suction pump 84 being driven by the motive force of the electric motor 85 every time the flushing is performed a predetermined number of times, the waste liquid accumulated in the cap 83 passes through the waste liquid tube 86 and is collected in the waste liquid box 71.

During a cleaning period after a predetermined time elapses from the previous cleaning time, as illustrated in FIG. 6, in a state in which the carriage unit 50 is at the home position HP, the electric motor 85 is driven under the capped state in which the cap 83 is in contact with the nozzle opening surface 52A of the liquid ejecting head 52. The cleaning is performed by the suction pump 84 being driven by the motive force of the electric motor 85. The liquid is forcefully eliminated from the nozzles 55 of the liquid ejecting head 52 due to the closed space between the nozzle opening surface 52A and the cap 83 assuming a negative pressure due to the driving of the suction pump 84. The eliminated liquid is stored in the cap 83 and passes from the cap 83 through the waste liquid tube 86 and is collected inside the waste liquid box 71.

Since the waste liquid tube 86 and the waste liquid box 71 are coupled to each other due to the supply needle 92 puncturing the supply port portion 95, the waste liquid fed to the waste liquid box 71 through the waste liquid tube 86 does not leak at the coupling location. The waste liquid collected inside the waste liquid box 71 is absorbed by a liquid absorption member 79.

The control section 100 measures the liquid amount collected in the waste liquid box 71 such as the liquid amount ejected from the nozzles 55 of the liquid ejecting head 52 during the flushing and the liquid amount eliminated from the nozzles 55 during the cleaning. The measured liquid amount is written to the memory element 97 of the waste liquid box 71 at a predetermined timing. Therefore, even if the waste liquid box 71 is exchanged, the control section 100 is capable of ascertaining the waste liquid amount collected inside the waste liquid box 71 by reading the data stored in the memory element 97.

When the waste liquid amount inside the waste liquid box 71 exceeds the upper limit value, the control section 100 displays a message that it is time to exchange the waste liquid box 71 on the display section 26 of the operation panel 24 or the display section of the host device. The user that views the message exchanges the waste liquid box 71.

Figure 13:
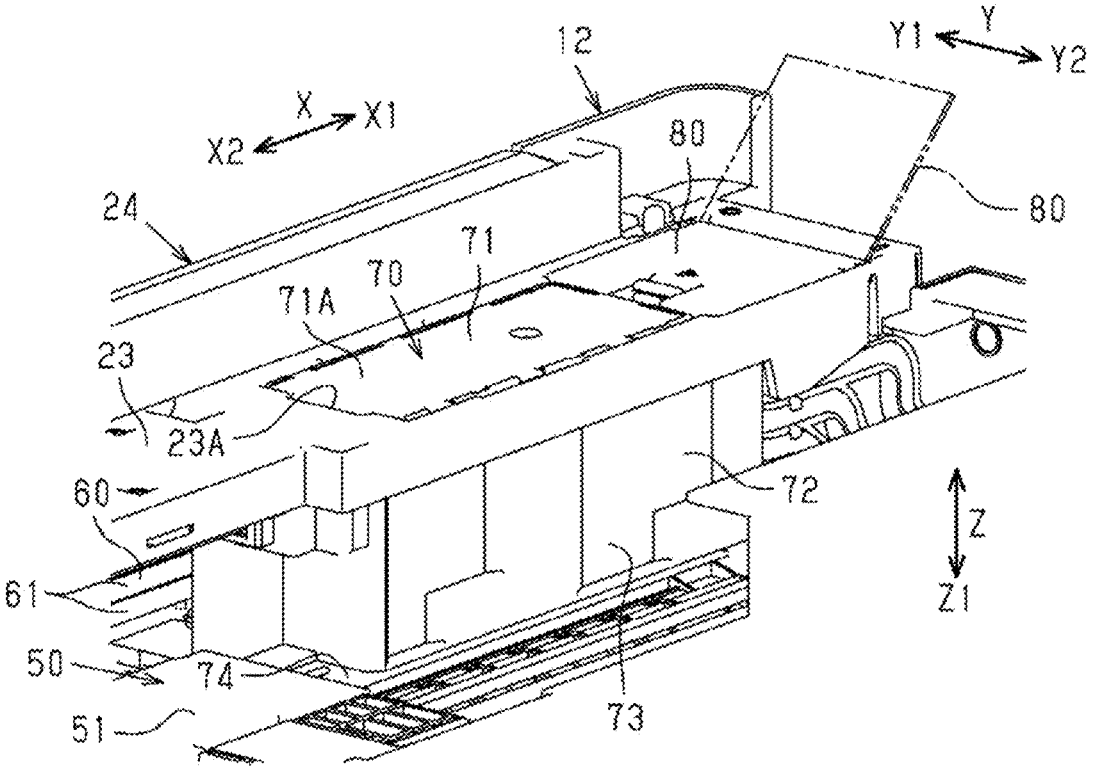
FIG. 13 is a perspective view illustrating a waste liquid unit.
Figure 14:
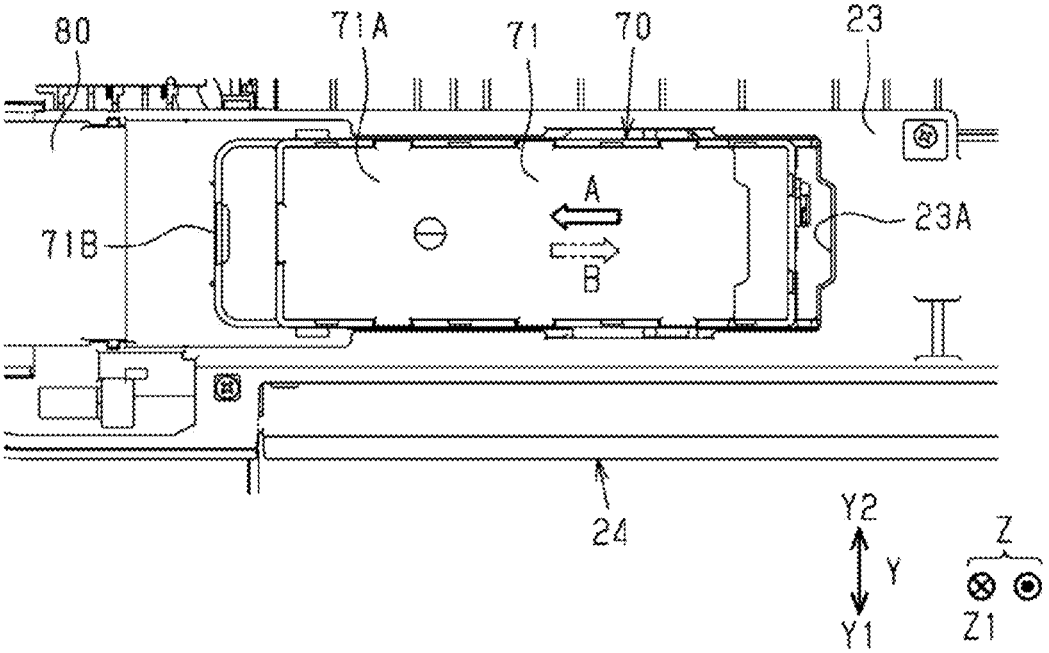
FIG. 14 is a plan view illustrating the waste liquid unit.

First, the user opens the cover 13 of the reading unit 30. When the cover 13 is opened, as illustrated in FIGS. 2 and 3, the waste liquid box 71 is exposed at the front top portion of the housing 12. When the user opens a cover 80 as illustrated by the double dot dashed line in FIG. 13, since the handle portion 71B illustrated in FIG. 14 is exposed, the user grips the handle portion 71B to slide the waste liquid box 71 by a predetermined distance in the first scanning direction X1 which is the removal direction illustrated by a white-filled arrow A in FIG. 14 (refer to FIG. 14). By sliding the waste liquid box 71, the locking between the first locking mechanism 93 and the second locking mechanism 96 is released and the supply needle 92 is pulled out from the supply port portion 95. At this time, the waste liquid box 71 is guided by the guide groove 76 and slides horizontally until the supply needle 92 is pulled out from the supply port portion 95. Therefore, there is no concern of an excessive load being applied to the supply needle 92 in the pulling-out process. At this time, due to the coupling between the first terminal and the second terminal (not illustrated) being severed, the electrical coupling between the control section 100 and the memory element 97 is cut.

Figure 15:
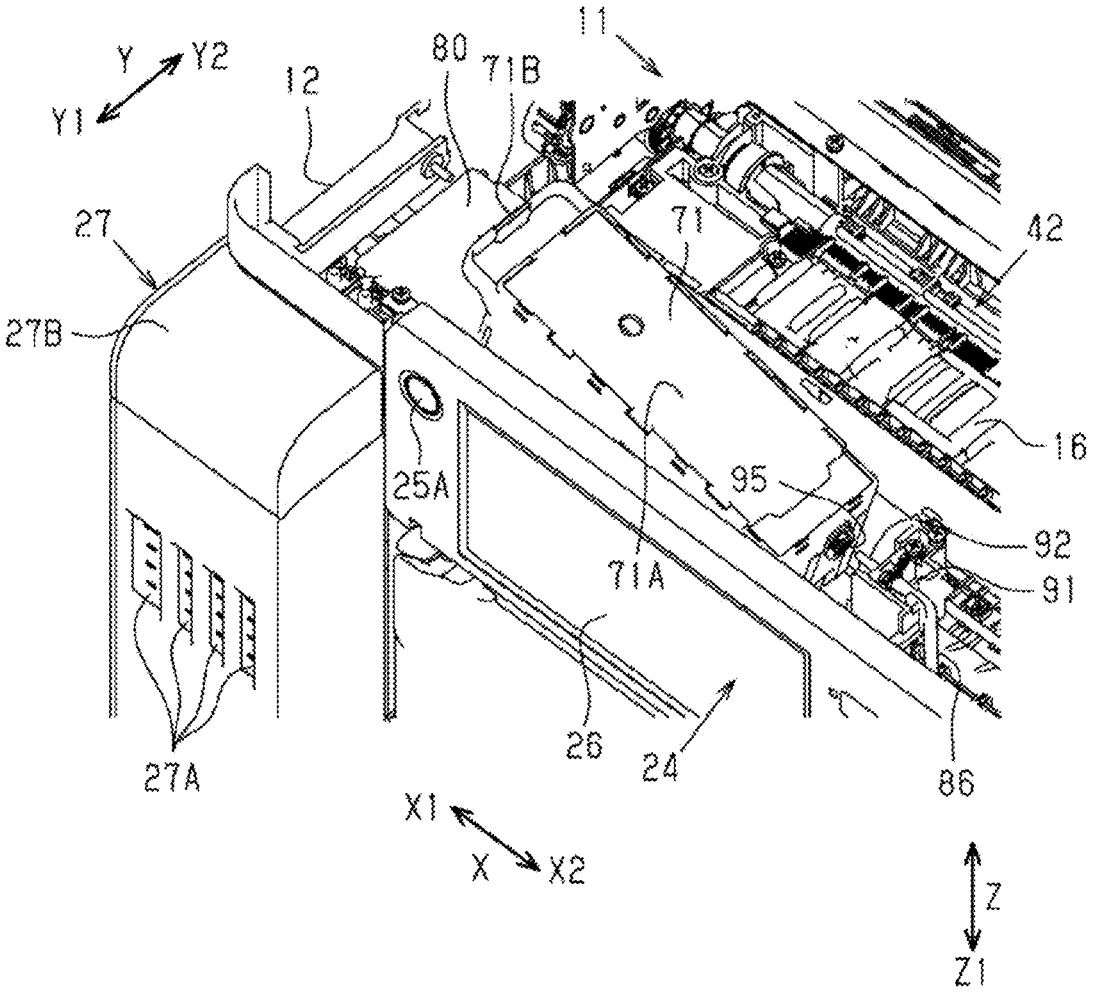
FIG. 15 is a perspective view illustrating a state in which the waste liquid unit is inclined.

When the sliding of a predetermined distance is finished, the engagement between the waste liquid box 71 and the guide groove 76 is released. Therefore, the movement of the waste liquid box 71 in a direction other than horizontal is possible. The user lifts up the handle portion 71B and inclines the waste liquid box 71 as illustrated in FIG. 15. The user removes the waste liquid box 71 from the holding section 73 as illustrated in FIG. 11. In this manner, the handle portion 71B of the waste liquid box 71 is gripped, caused to slide horizontally, the handle portion 71B is subsequently lifted upward, and the waste liquid box 71 is inclined and removed from the holding section 73.

Next, the user sets the new waste liquid box 71 in the holding section 73 using the reverse procedure from the removal process described earlier. In other words, the waste liquid box 71 is set to a state in which the end portion on the supply port portion 95 side leads and the holding section 73 is inclined diagonally and the base portion of the waste liquid box 71 is caused to engage with the guide groove 76. Subsequently, the waste liquid box 71 is set to a horizontal posture from the inclined posture, caused to slide in the second scanning direction X2 which is the mounting direction illustrated by a double dot dashed arrow B in FIG. 14 in the horizontal posture, and is finally pushed in. In the process of pushing in the waste liquid box 71, the supply needle 92 pierces the supply port portion 95 and the first locking mechanism 93 and the second locking mechanism 96 are locked together. In this manner, the waste liquid box 71 is joined to the waste liquid tube 86 via the supply needle 92 in a state in which leaking will not occur.

As illustrated in FIG. 4, the dead space DS which is not used for the movement of the curved portion 62 is formed in a region outside of the movement region TA in which the curved portion 62 moves along the X-axis in the space which is formed between the fixed portion 61C of the tube bundle 60 and the scanning region SA of the carriage unit 50 in the transport direction Y1 inside the housing 12. In the present example, the holding section 73 and the waste liquid unit 70 held by the holding section 73 are disposed in the dead space DS. Therefore, in the entire movement range in which the carriage unit 50 moves along the X-axis between the home position HP and the anti-home position AH, the curved portion 62 does not come into contact with the holding section 73 and the waste liquid unit 70. In other words, whatever position the carriage unit 50 is at on the movement path, the curved portion 62 of the tubes 61 does not come into contact with the holding section 73 and the waste liquid box 71.

As illustrated in FIGS. 7 and 9, the top end of the waste liquid box 71 held by the holding section 73 is positioned above the tube bundle 60 and the bottom end of the waste liquid box 71 is positioned below the tube bundle 60. The top end surface 71A of the waste liquid box 71 held by the holding section 73 is positioned higher than the top end surface 50A of the carriage unit 50. Therefore, it is possible to lengthen the height dimension of the waste liquid box 71 capable of being stored inside the housing 12. This leads to an increase in the waste liquid storage volume of the waste liquid box 71.

As illustrated in FIG. 8, when the cover 13 of the reading unit 30 is closed, the top surface 23B of the front member 23 in which the top end surface 71A of the waste liquid box 71 is exposed serves as the receiving surface which receives the base surface 30A of the reading unit 30. The base surface 30A of the reading unit 30 includes a level difference portion 30B. A portion of the reading unit 30 corresponding to the exposed surface of the waste liquid box 71 and the top surface 23B in a state in which the cover 13 is closed is recessed upward. It is possible to secure a longer height dimension of the waste liquid box 71 capable of being stored inside the housing 12 by an amount corresponding to the height of the level difference portion 30B. This leads to a further increase in the waste liquid storage volume of the waste liquid box 71.

The holding section 73 which holds the waste liquid box 71 is disposed at a position downstream of the scanning region SA of the carriage 51 in the transport direction Y1 and above the discharge section 43. The holding section 73 is positioned above the downstream portion of the discharge section 43 in the transport direction Y1. Of the two discharge roller pairs 46 and 47 which configure the discharge section 43, the holding section 73 is positioned above the second discharge roller pair 47 which is the one on the side positioned downstream in the transport direction Y1. The holding section 73 is positioned above the second transport path K2. In the present embodiment, a space is formed inside the housing 12 above a portion of the discharge section 43 that extends to a downstream region of the scanning region SA of the carriage 51 in the transport direction Y1. The holding section 73 and the waste liquid box 71 are disposed using the space formed in the region downstream of the scanning region SA of the carriage 51 in the transport direction Y1 and the region above the discharge section 43. Therefore, it is possible to avoid an increase in the size of the liquid ejecting apparatus 11 which becomes a problem when a dedicated space is provided for disposing the holding section 73.

In the present embodiment, in order to invert the medium M in which the printing of the first surface is finished in order to perform duplex printing, the second transport path K2 is provided under the first transport path K1 for transporting the medium M in the second transport direction Y2. In addition to the first discharge roller pair 46 which performs the transporting and the discharging of the medium M at a position downstream of the liquid ejecting head 52 in the transport direction Y1, the discharge section 43 is provided with the second discharge roller pair 47 which performs the discharging and the switch-back transporting of the medium M at a position downstream of the first discharge roller pair 46 in the transport direction Y1. During the duplex printing, the medium M is switch-back transported from the first transport direction Y1 to the second transport direction Y2 due to the second discharge roller pair 47 rotating in reverse after the medium M in which the first service is printed is partway discharge by the two discharge roller pairs 46 and 47. The medium M which is switch-back transported is guided to the second transport path K2. The medium M which is transported in reverse by the inverting roller pair 49 via the second transport path K2 is inverted via the outer circumference of the intermediate roller 44 and is transported toward the printing region by the transport roller pair 45 oriented such that the second surface is capable of facing the liquid ejecting head 52. The medium M in which the second surface is printed is discharge from the discharge port 15 by the two discharge roller pairs 46 and 47 is stacked on the discharge tray 22.

The liquid ejecting apparatus 11 of the present embodiment is provided with the second discharge roller pair 47 in a downstream region of the scanning region SA of the carriage unit 50 in the transport direction Y1. In other words, the second discharge roller pair 47 which switch-back transports the medium M and guides the medium M to the second transport path K2 is provided at a position downstream of the first discharge roller pair 46 in the transport direction Y1. Therefore, a comparatively wide space is formed in a downstream region of the scanning region SA of the carriage unit 50 in the transport direction Y1 inside the housing 12, that is, above the second discharge roller pair 47. In the present embodiment, using this space, the tube bundle 60 is routed in a routing path which forms the curved portion 62 which curves horizontally accompanying a displacement in the transport direction Y1.

The curved portion 62 of the tubes 61 requires a predetermined curvature radius or greater for the flow path of the tubes not to be crushed. When the carriage unit 50 moves in the entire scanning range, the curved portion 62 moves in a range of approximately half of the upper space inside of the housing 12 close to the home position HP. Therefore, the portion of the space outside of the movement region TA of the curved portion 62 forms the dead space DS. The holding section 73 and the waste liquid box 71 are disposed using the dead space DS. By disposing the holding section 73 and the waste liquid box 71 at the front portion inside the housing 12, another mechanism is disposed in the space formed at the rear portion of the housing 12. In the present example, the feeding mechanism 87 illustrated in FIG. 5 is disposed in the space formed at the rear portion of the housing 12. Accordingly, even if the holding section 73 and the waste liquid box 71 are disposed at the front portion inside the housing 12, this does not lead to an increase in the size of the liquid ejecting apparatus 11.

The holding member 72 assembled onto the front portion inside the housing 12 and formed integrally with the holding section 73 illustrated in FIG. 12 forms the routing path of the tube bundle 60 between the holding section 73 and the side plate portion 75 and includes the plurality of pairs of ribs 77 which pinch and hold the routed tube bundle 60. Even if the first linear portion 61A of the routed tube bundle 60 hypothetically sags, the first linear portion 61A comes into contact with the base plate portion 74 and further sagging is prevented. For example, it is possible to avoid the medium M which is transported toward the discharge port 15 coming into contact with the sagging tube bundle 60 and to avoid jamming that occurs originating in such contacting.

According to the embodiments described above, it is possible to obtain the following effects.

(1) The liquid ejecting apparatus 11 is provided with the transport section 42 which transports the medium M in the transport direction Y1, the liquid ejecting head 52 which ejects the liquid onto the medium M, the carriage 51 (an example of the head support portion) which supports the liquid ejecting head 52, the liquid storage containers 28 which store the liquid to be supplied to the liquid ejecting head 52, and the discharge section 43 which discharges the medium M onto which the liquid is ejected. The liquid ejecting apparatus 11 is provided with the holding section 73 which holds the waste liquid box 71 capable of storing the liquid eliminated from the liquid ejecting head 52 as the waste liquid. The holding section 73 disposed at a position downstream of the carriage 51 in the transport direction Y1 and above the discharge section 43.

Accordingly, it is possible to use the space avoiding the head support portion of the space above the discharge section 43 to dispose the holding section 73 which holds the waste liquid box 71. The location which avoids the head support portion above the discharge section 43 is a position to which the user has easy access as compared to the rear portion of the liquid ejecting apparatus 11. Therefore, it is possible to increase the workability during the exchanging of the waste liquid box 71 while suppressing an increase in the size of the liquid ejecting apparatus 11 as much as possible.

(2) The discharge section 43 is provided with two roller pairs 46 and 47 disposed at different positions in the transport direction Y1. The holding section 73 is disposed at a position above the roller pair 47 which is one of the two roller pairs 46 and 47 that is positioned downstream in the transport direction Y1. Accordingly, the holding section 73 is positioned above the roller pair 47 which is one of the two roller pairs 46 and 47 configuring the discharge section 43 that is positioned downstream in the transport direction Y1. It is possible to dispose the holding section 73 using the space above the one roller pair 47.

(3) In the liquid ejecting apparatus 11, the second transport path K2 in which the medium M, after the liquid is ejected, is transported in the second transport direction Y2 which is the opposite direction from the transport direction Y1 is included under the first transport path K1. The discharge section 43 feeds the medium M to the second transport path K2 by transporting the medium M in reverse in the second transport direction Y2 after discharging the medium M partway in the transport direction Y1. The holding section 73 is positioned downstream of the carriage 51 in the transport direction Y1 and above the second transport path K2. Accordingly, the second transport path K2 in which the medium M, after the liquid is ejected, is transported in the second transport direction Y2 is provided. Therefore, as compared to a configuration in which the medium M is discharge in the first transport direction Y1, since it is necessary to temporarily discharge the medium M to partway in the first transport direction to a position at which it is possible to guide the rear end of the medium M in the first transport direction to the entrance of the second transport path K2, the transport path of the discharge section 43 is long in the transport direction and a space forms easily above the downstream region portion of the second transport path K2 in the first transport direction Y1. It is possible to dispose the holding section 73 using this space.

(4) The carriage 51 is capable of reciprocally moving in the scanning directions which intersect the transport direction Y1 at a position above the transport paths K1 and K2 of the medium M and the liquid ejecting head 52 moves together with the carriage 51. The holding section 73 disposed at a position downstream of the carriage 51 in the transport direction Y1 and above the discharge section 43. Accordingly, it is possible to dispose the holding section 73 using the space above the discharge section 43 without impeding the movement of the carriage 51.

Therefore, the workability during the exchanging of the waste liquid box 71 is increased and it is possible to suppress an increase in the size of the liquid ejecting apparatus 11.

(5) The holding section 73 is disposed above the discharge port 15 included in the housing 12. Accordingly, it is possible to secure a greater waste liquid storage volume of the waste liquid box 71 while avoiding contact between the holding section 73 and the medium M to be transported toward the discharge port 15.

(6) The liquid ejecting apparatus 11 is provided with the housing 12 including the opening 12A in the top portion and the openable/closable cover 13 which covers the opening 12A of the housing 12. The holding section 73 holds the waste liquid box 71 in an exposed state when the cover 13 is opened. Accordingly, since the waste liquid box 71 inside the housing 12 is exposed when the cover 13 is opened, the workability of the exchanging of the waste liquid box 71 is improved.

(7) The liquid ejecting apparatus 11 is provided with the maintenance device 81 which performs maintenance on the liquid ejecting head 52 in a state in which the carriage 51 is positioned at the maintenance position which is at one end portion of the carriage 51 in the movement path. The holding section 73 is positioned close to one side which is the opposite side from the maintenance position in the movement directions of the carriage 51 inside the housing 12. Accordingly, the movement region TA of the tubes 61 is set and the tubes 61 are routed in the movement region TA such that the dead space DS in which the holding section 73 may be disposed is formed close to one side which is the opposite side from the maintenance position. In this case, when the carriage 51 is at the home position HP, since the curved portion 62 is positioned close to the carriage 51, the curved portion 62 does not sag easily.

(8) The holding section 73 is positioned close to one side which is the same side as the side on which the liquid storage containers 28 are disposed in the movement directions of the carriage 51 inside the housing 12. Accordingly, the tubes 61 which extend from the liquid storage containers 28 may be routed to form the curved portion 62 on the opposite side from the liquid storage containers 28. It is possible to dispose the holding section 73 in the dead space DS outside of the movement region TA of the tubes 61.

(9) The liquid ejecting apparatus 11 is provided with the tubes 61 which are coupled to the carriage 51 and through which the liquid supplied from the liquid storage containers 28 disposed at a different position from the carriage 51 to the liquid ejecting head 52 passes. The bottom end of the holding section 73 is positioned below the tubes 61. Accordingly, it is possible to gain a greater height dimension of the waste liquid box 71 and it is possible to secure a great waste liquid storage volume of the waste liquid box 71.

(10) The top end surface 71A of the waste liquid box 71 held by the holding section 73 is positioned higher than the top end surface 50A of the carriage 51.

Accordingly, it is possible to secure a long height dimension of the waste liquid box 71 and it is possible to secure a great waste liquid storage volume of the waste liquid box 71.

(11) The liquid ejecting apparatus 11 is provided with the tubes 61 through which the liquid supplied from the liquid storage containers 28 disposed at a different position from the carriage 51 to the liquid ejecting head 52 passes, the waste liquid tube 86 through which the waste liquid pumped from the maintenance device 81 to the waste liquid box 71 passes, and the partitioning wall portion 78 which separates the tubes 61 and the waste liquid tube 86 from each other. Accordingly, since the tubes 61 through which the liquid supplied from the liquid storage containers 28 passes and the waste liquid tube 86 are separated by the partitioning wall portion 78 so as to not intersect each other, it is possible to avoid problems such as the tubes 61 for supplying the liquid becoming tangled with the waste liquid tube 86 when the tubes 61 move.

(12) The holding section 73 includes the supply needle 92 which couples the waste liquid box 71 to the waste liquid tube 86. The holding section 73 is provided with the attaching/detaching mechanism 90 which attaches and detaches the waste liquid box 71 with respect to the holding section 73 such that it is possible to couple and remove the waste liquid box 71 to the supply needle 92 by sliding the waste liquid box 71 in the movement directions of the carriage 51. Accordingly, it is possible to prevent leakage of the waste liquid between the waste liquid box 71 and the waste liquid tube 86 due to the waste liquid box 71 being coupled to the supply needle 92 by the attaching/detaching mechanism 90. It is possible to attach and detach the waste liquid box 71 with respect to the supply needle 92 by sliding the waste liquid box 71. Since the sliding directions during the attachment and detachment are the same as the movement directions of the carriage 51, even if the waste liquid box 71 is caused to slide, the waste liquid box 71 does not easily come into contact with the tubes 61.

(13) The tubes 61 are provided to form the curved portion 62 which is curved and doubles back in an orientation accompanying the displacement in the transport direction Y1 and to cause the formation position of the curved portion 62 to move in accordance with the movement of the carriage 51. In the attaching/detaching mechanism 90, the waste liquid box 71 is removed when the waste liquid box 71 is caused to slide in a direction toward the opposite side from the side on which the curved portion 62 is positioned in the movement directions of the carriage 51. Accordingly, the waste liquid box 71 does not easily come into contact with the curved portion 62 of the tubes 61 when removing the waste liquid box 71. When the waste liquid box 71 is configured to be removed by being caused to slide to the curved portion 62 side, it is necessary to secure enough space for a stroke when sliding the waste liquid box 71 to the curved portion 62 side inside the dead space DS. In contrast, if the configuration of the present embodiment is adopted, since it is not necessary to secure enough space for a slide stroke of the waste liquid box 71 inside the dead space DS, it is possible to secure a greater occupancy volume of the holding section 73 and the waste liquid box 71 inside the dead space DS and to secure a greater waste liquid storage volume of the waste liquid box 71.

(14) The liquid ejecting apparatus 11 is provided with tubes 61 which are coupled to the carriage 51 and through which the liquid supplied from the liquid storage containers 28 to the liquid ejecting head 52 passes. The tubes 61 include the movable portion which forms the curved portion 62 which is curved in an orientation accompanying the displacement in the transport direction Y1 and in which the formation position of the curved portion 62 moves in accordance with the movement of the carriage 51 and the fixed portion which is not movable. The holding section 73 is disposed between the fixed portion 61C and the scanning region SA of the carriage 51 in the transport direction Y1. The curved portion 62 of the tubes 61 moves by a movement amount of approximately half of the movement amount of the carriage 51 in accordance with the movement of the carriage 51. The holding section 73 and the waste liquid box 71 are disposed in the region which is approximately the remaining half outside of the movement region TA of the curved portion 62, that is, holding section 73 and the waste liquid box 71 are disposed in the dead space DS which is not used in the movement of the curved portion 62 formed between the scanning region SA of the carriage 51 and the fixed portion 61C of the tubes 61. Therefore, the holding section 73 and the waste liquid box 71 do not impede the movement of the carriage 51 and the movement of the tubes 61. The location between the scanning region SA of the carriage 51 and the fixed portion 61C has favorable user accessibility as compared to the rear portion of the liquid ejecting apparatus 11. Accordingly, it is possible to increase the workability during the exchanging of the waste liquid box 71 while suppressing an increase in the size of the liquid ejecting apparatus 11 as much as possible.

(15) The holding section 73 is disposed on the outside of the movement region TA of the tubes 61 inside the housing 12. Accordingly, it is possible to dispose the holding section 73 and the waste liquid box 71 using the dead space which is not used as the movement region of the tubes 61 without impeding the movement of the tubes 61. Therefore, the workability during the exchanging of the waste liquid box 71 is improved while suppressing an increase in the size of the liquid ejecting apparatus 11 as much as possible.

(16) The holding section 73 is disposed above the transport paths K1 and K2 in which the transport mechanism 40 transports the medium M inside the housing 12 and is disposed downstream of the scanning region SA of the carriage 51 in the transport direction Y1. Accordingly, since the holding section 73 is disposed above the transport path and downstream of the scanning region SA of the carriage 51 in the transport direction Y1, the workability during the exchanging of the waste liquid box 71 is improved.

(17) The liquid ejecting apparatus 11 is provided with the maintenance device 81 which performs maintenance on the liquid ejecting head 52 in a state in which the carriage 51 is positioned at the maintenance position which is at one end portion of the carriage 51 in the movement path. The holding section 73 includes the supply needle 92 provided on one end of the waste liquid tube 86 which extends from the maintenance device 81. The waste liquid box 71 includes the supply port portion 95 which is coupled to the supply needle 92. Accordingly, when the waste liquid box 71 is mounted to the holding section 73, the supply needle 92 and the supply port portion 95 are coupled to each other. Therefore, it is possible to collect the liquid which the maintenance device 81 causes to be discharged from the liquid ejecting head 52 in the waste liquid box 71 through the waste liquid tube 86. At this time, since the waste liquid is collected in the waste liquid box 71 through the coupling between the supply needle 92 and the supply port portion 95, it is possible to suppress waste liquid leakage at the coupling location.

The embodiment may also be modified in forms such as the modification examples described below. It is possible to use forms obtained by combining, as appropriate, the embodiment and the modification examples described hereinafter as further modification examples and it is possible to use forms obtained by combining, as appropriate, the modification examples described hereinafter with each other as further modification examples.

A routing path of the tubes 61 which disposes the curved portion 62 of the tubes 61 on the anti-home position AH side with respect to the carriage unit 50 may be adopted. For example, in the embodiment, the liquid storage containers 28 are disposed on the home position HP side and the routing path of the tubes 61 is laid out in linear symmetry to a perpendicular line passing through the width center of the housing 12 of the embodiment. In this case, the home position HP and the anti-home position AH may be set to the opposite positions. In this case, the waste liquid box 71 may be disposed in the dead space DS. The home position HP and the anti-home position AH may be set to the opposite positions in the routing path of the tubes 61 of the embodiment.

In the embodiment, although the liquid ejecting apparatus 11 is configured as a so-called off-carriage type in which the liquid storage containers 28 are disposed at a different position from the carriage 51, a so-called on-carriage type in which the liquid storage containers 28 are installed on the carriage 51 may be adopted. In other words, the liquid ejecting apparatus 11 may be configured to not include the tubes 61 for supplying the liquid. In this case, even if the dead space DS of the tubes 61 is not used, it is possible to dispose the holding section 73 at a position downstream of the carriage 51 in the transport direction Y1 and above the discharge section 43. The holding section 73 may be positioned anywhere in a direction parallel to the width of the housing 12. For example, the holding section 73 may be close to the maintenance position side. In this case, the liquid storage containers 28 may be disposed on the home position HP side. The liquid storage containers 28 may use a pouring system and may use a pack format.

In the embodiment, there may be a single discharge roller pair. There may be a plurality of three or more discharge roller pairs.

The waste liquid box 71 may be caused to slide in a direction heading toward the curved portion 62 when removing the waste liquid box 71 from the holding section 73.

The holding section 73 may be disposed close to one side on the home position HP side. In this case, the routing path of the tubes 61 is opposite that of the embodiment such that the curved portion 62 of the tubes 61 is positioned on the anti-home position AH side.

The second transport path K2 may not be present. If the first transport path K1 extends into the downstream region of the scanning region SA of the carriage 51 by a predetermined length or greater in the transport direction Y1, the holding section 73 may be disposed at a position above the first transport path K1.

A single roller pair configuring the discharge section 43 is sufficient as long as the roller pair is downstream of the head support portion of the carriage 51 or the like. The holding section 73 may be disposed using the space above the single roller pair.

The discharge section 43 may be a belt transporting system instead of a roller transporting system. Two rollers in different positions in the transport directions configuring the discharge section 43 may be rollers along which a transport belt is stretched.

The attaching/detaching mechanism 90 of the waste liquid box 71 may be a system in which the waste liquid box 71 is caused to slide in the vertical direction Z1 to attach and detach the waste liquid box 71 instead of the configuration in which the waste liquid box 71 is caused to slide in the horizontal directions to attach and detach the waste liquid box 71.

The attaching/detaching mechanism 90 may be configured such that the waste liquid box 71 is attached and detached by causing the waste liquid box 71 to slide forward and backward. In this case, a configuration may be adopted in which the waste liquid box 71 is caused to slide forward and subsequently pulled out in the vertical direction Z1 during the removal. The configuration may be adopted in which a cover is provided on the front surface of the housing at a position corresponding to the holding section 73 and the waste liquid box 71 is removed by opening the cover and subsequently causing the waste liquid box 71 to slide forward.

The attaching/detaching mechanism 90 may be configured such that the waste liquid box 71 is pulled out from the side surface of the housing 12 by causing the waste liquid box 71 to slide horizontally to the opposite side from the curved portion 62 side. In this case, the cover may be provided on the side surface of the housing 12 and the end surface of the waste liquid box 71 may be exposed at the side surface of the housing 12. The holding section 73 may be a box body including an opening 73A in an orientation facing the side surface of the housing 12.

The tubes 61 may be routed in the space upstream of the carriage 51 in the transport direction Y1. In this case, the holding section 73 may be disposed between the fixed portion 61C and the scanning region SA of the carriage 51. In this configuration, it is possible to open the cover 13 to attach or detach the waste liquid box 71.

A configuration may be adopted in which the waste liquid box 71 is not exposed when the cover 13 is opened. For example, a configuration may be adopted in which when the cover is opened, the waste liquid box 71 is covered by an inner cover, the inner cover is opened, and the waste liquid box 71 is attached or detached. Since exposing the waste liquid box 71 when the cover 13 is opened makes a longer height dimension of the waste liquid box 71 possible, it is possible to increase the waste liquid storage volume. A configuration may be adopted in which the waste liquid box 71 is covered by the front member 23 and held thereunder and the front member 23 is removed to attach or detach the waste liquid box 71.

The supply mechanism 91 may be removed. In other words, the waste liquid may drop from the waste liquid tube 86 into the liquid absorption member 79 inside the waste liquid box 71 without coupling the waste liquid box 71 and the waste liquid tube 86 to each other with the supply needle 92 or the like. In this case, it is preferable to provide a waste liquid leakage prevention mechanism or a mechanism which collects leaked waste liquid.

It is sufficient for the waste liquid unit 70 and the tube bundle 60 to include a portion disposed at the same height in the vertical direction Z1. In other words, it is unnecessary for all portions of the tube bundle 60 to be at the same height as the waste liquid unit 70 in the vertical direction Z1. For example, the top end of the waste liquid box 71 may be positioned at the same height as or a lower height than the top end of the tube bundle 60. For example, the base surface 73B which is the bottom end of the holding section 73 may be positioned at the same height as or a higher position than the bottom end of the tube bundle 60.

The orientation at which the curved portion 62 is curved, that is, the orientation at which the tubes 61 curve as the tubes 61 are displaced in the transport direction Y1 is not limited to being horizontal. The orientation at which the tubes 61 curve may be an orientation parallel to the transport surface of the medium M. For example, when the transport surface of the portion facing the liquid ejecting head 52 is an inclined surface which is inclined at a predetermined angle with respect to horizontal, the curved portion 62 may be obtained by causing the tubes 61 to curve at an orientation inclined at a predetermined angle with respect to horizontal.

The holding section 73 may be positioned separated in the transport direction Y1 from a position above the roller pair 47 which is one of the two roller pairs 46 and 47 configuring the discharge section 43 that is positioned downstream in the transport direction Y1. Even in this case, the holding section 73 may be positioned above the second transport path K2.

The waste liquid unit 70 and the tube bundle 60 may not include a portion disposed at the same height in the vertical direction Z1. Since there is no concern of the tube bundle 60 and the waste liquid box 71 coming into contact with each other even if the curved portion 62 of the tube bundle 60 moves as long as the positions of the waste liquid box 71 and the tube bundle 60 are different from each other in the vertical direction Z1, it is possible to freely choose the layout of the holding section 73 without being limited to the dead space DS. For example, the long waste liquid box 71 which has a length close to the entire width region inside the housing 12 may be disposed at a height above the curved portion 62.

The holding section 73 may be disposed in a region downstream of the tube bundle 60 in the transport direction Y1. In this case, if the holding section 73 is positioned in a downstream region of the head support portion of the carriage 51 or the like in the transport direction Y1 and above the discharge section 43, it is possible to use the space above the discharge section 43 to dispose the waste liquid box 71 and the workability during the exchanging of the waste liquid box 71 is improved.

The tubes 61 are not limited to the configuration of a tube bundle in which a plurality of tubes are bundled and may be configured by a single tube. For example, a configuration may be adopted in which the liquid ejecting apparatus 11 which prints in black monochrome is provided with the single tube 61. When a tube bundle is configured, there may be a plurality other than four of the tubes.

The liquid ejecting apparatus 11 is not limited to a printing apparatus which prints on paper or film as the medium, and may be a textile printing device which prints on a fabric.

The liquid ejecting apparatus is not limited to a serial printer in which the carriage unit 50 reciprocally moves in the scanning directions X1 and X2, and may be a lateral printer in which the carriage unit 50 is capable of moving in the two directions of the main scanning direction and the sub-scanning direction.

The liquid ejecting apparatus 11 may be a line printer. In the case of the line printer, the line head may be a multi-headed type formed by arranging a plurality of discharging heads and may be configured to include a single long line head including a plurality of nozzle rows formed by arranging the nozzles 55 at a fixed pitch over the entire region of the printing region spanning the width directions which intersect the transport direction of the medium M. In the case of the line printer, the line head corresponds to the liquid ejecting head and the line head is supported by the head support portion.

The liquid ejecting apparatus is not limited to a multi-function device and may be a printer including the cover 13 on which the reading unit 30 is not installed.

The medium M is not limited to paper and may be a flexible plastic film, a fabric, a non-woven fabric, or the like.

The liquid ejecting apparatus is not limited to a printer for printing. For example, the liquid ejecting apparatus may eject liquid-state matter in which particles of a functional material are dispersed or mixed into a liquid and manufacture an electrical wiring pattern on a substrate which is an example of the medium or manufacture pixels of a display of various systems such as liquid crystal, electro-luminescence (EL), or surface emission. The liquid ejecting apparatus may also be a liquid ejecting apparatus for three-dimensional formation in which an uncured resin liquid is ejected to form a three-dimensional object.

The technical idea to be ascertained from the embodiment and modification examples will be described hereinafter together with the operations and effects thereof.

A liquid ejecting apparatus includes a transport section which transports a medium in a transport direction, a liquid ejecting head which ejects a liquid onto the medium, a head support portion which supports the liquid ejecting head, a liquid storage container which stores the liquid to be supplied to the liquid ejecting head, an discharge section which discharges the medium onto which the liquid is ejected, and a holding section which holds a waste liquid storage body configured to store the liquid eliminated from the liquid ejecting head as a waste liquid, in which the holding section is disposed at a position downstream of the head support portion in the transport direction and above the discharge section. In this configuration, it is possible to use the space avoiding the head support portion of the space above the discharge section to dispose the holding section which holds the waste liquid storage body. The location which avoids the head support portion above the discharge section is a position to which the user has easy access as compared to the rear portion of the liquid ejecting apparatus. Therefore, it is possible to increase the workability during the exchanging of the waste liquid storage body while suppressing an increase in the size of the liquid ejecting apparatus as much as possible.

In the liquid ejecting apparatus, the discharge section may includes two rollers disposed at different positions in the transport direction, and the holding section may be disposed at a position above one of the two rollers that is positioned on the downstream side in the transport direction.

In this configuration, the holding section is positioned above the roller pair which is one of the two roller pairs configuring the discharge section that is positioned downstream in the transport direction. It is possible to dispose the holding section using the space above the one roller pair.

In the liquid ejecting apparatus, the transport section may include a second transport path in which the medium is transported after the liquid is ejected thereon in a second transport direction which is an opposite direction from the transport direction below a first transport path in which the medium is transported, the discharge section may feed the medium to the second transport path by discharging the medium partway in the transport direction and subsequently transporting the medium in reverse in the second transport direction, and the holding section may be positioned at a position downstream of the head support portion in the transport direction above the second transport path.

In this configuration, since the second transport path which transports the medium in the second transport direction after the liquid is ejected thereon is provided, as compared to a configuration in which the medium is discharge in the first transport direction, since it is necessary to temporarily discharge the medium to partway in the first transport direction to a position at which it is possible to guide the rear end of the medium in the first transport direction to the entrance of the second transport path, the transport path of the discharge section is long in the transport direction and a space forms easily above the downstream region portion of the second transport path in the first transport direction. It is possible to dispose the holding section using this space.

In the liquid ejecting apparatus, the head support portion may be a carriage configured to reciprocally move in scanning directions which intersect the transport direction at a position above a transport path of the medium, the liquid ejecting head may move together with the carriage, and the holding section may be disposed at a position downstream of the carriage in the transport direction and above the discharge section.

In this configuration, it is possible to dispose the holding section using the space above the discharge section without impeding the movement of the carriage. Therefore, the workability during the exchanging of the waste liquid storage body is increased and it is possible to suppress an increase in the size of the liquid ejecting apparatus.

The liquid ejecting apparatus may further include a housing which stores the liquid ejecting head and the holding section, in which the housing may include an discharge port from which the medium is discharge, and the holding section may be disposed above the discharge port.

In this configuration, it is possible to secure a greater storage volume of the waste liquid stored in the waste liquid storage body while avoiding contact between the holding section and the medium to be discharge.

The liquid ejecting apparatus may further include a housing which stores the liquid ejecting head and the holding section, and a cover configured to open and close which covers an opening in a top portion of the housing, in which the holding section may hold the waste liquid storage body in an exposed state when the cover is opened.

In this configuration, since the waste liquid storage body inside the housing is exposed when the cover is opened, the workability of the exchanging of the waste liquid storage body is improved.

The liquid ejecting apparatus may further include a maintenance device which performs maintenance on the liquid ejecting head in a state in which the carriage is positioned at a maintenance position which is one end portion of a movement path of the carriage, in which the holding section may be positioned close to one side which is an opposite side from the maintenance position in movement directions of the carriage inside the housing.

In this configuration, it is possible to dispose the holding section using the region which is approximately the remaining half outside of the movement region of the tube which moves by approximately half the movement amount of the movement amount of the carriage in accordance with the movement of the carriage. Accordingly, it is possible to dispose the holding section at a position which does not impede the movement of the carriage and the movement of the tube.

In the liquid ejecting apparatus, the holding section may be positioned close to one side which is the same side as a side on which the liquid storage container is disposed in movement directions of the carriage inside the housing.

In this configuration, the tube which extends from the liquid storage container may be routed to form the curved portion on the opposite side from the liquid storage container. It is possible to dispose the holding section in the dead space outside of the movement region of the tube.

The liquid ejecting apparatus may further include a tube which is coupled to the carriage and through which a liquid supplied to the liquid ejecting head from the liquid storage container disposed at a different position from the carriage passes, in which a bottom end of the holding section may be positioned below the tube.

In this configuration, it is possible to gain a greater height dimension of the waste liquid storage body and it is possible to secure a great waste liquid storage volume of the waste liquid storage body.

In the liquid ejecting apparatus, a top end of the waste liquid storage body held by the holding section may be positioned above a top end of the carriage.

In this configuration, it is possible to gain a greater height dimension of the waste liquid storage body and it is possible to secure a great waste liquid storage volume of the waste liquid storage body.

The liquid ejecting apparatus may further include a tube through which a liquid supplied to the liquid ejecting head from the liquid storage container disposed at a different position from the carriage passes, a waste liquid tube through which a waste liquid pumped from the maintenance device to the waste liquid storage body passes, and a partitioning wall portion which separates the tube and the waste liquid tube from each other.

In this configuration, since the tube through which the liquid supplied from the liquid storage container passes and the waste liquid tube are separated by the partitioning wall portion so as to not intersect each other, it is possible to avoid problems such as the tubes for supplying the liquid becoming tangled with the waste liquid tube when the tubes move.

In the liquid ejecting apparatus, the holding section may include a coupling portion which couples the waste liquid storage body to the waste liquid tube, and the holding section may be provided with an attaching/detaching mechanism which attaches and detaches the waste liquid storage body with respect to the holding section to configure the waste liquid storage body to couple to and be removed from the coupling portion by causing the waste liquid storage body to slide in the movement directions of the carriage.

In this configuration, it is possible to prevent leakage of the waste liquid between the waste liquid storage body and the waste liquid tube due to the waste liquid storage body being coupled to the coupling portion by the attaching/detaching mechanism. It is possible to attach and detach the waste liquid storage body with respect to the coupling portion by sliding the waste liquid storage body. Since the sliding directions during the attachment and detachment are the same as the movement directions of the carriage, even if the waste liquid box is caused to slide, the waste liquid storage body does not easily come into contact with the tube.

In the liquid ejecting apparatus, the tube may be provided to form a curved portion which curves and doubles back toward downstream in the transport direction and to cause a formation position of the curved portion to move in accordance with movement of the carriage, and in the attaching/detaching mechanism, the waste liquid storage body may be removed by sliding the waste liquid storage body in a direction toward an opposite side from a side on which the curved portion is positioned in the movement directions of the carriage.

In this configuration, the waste liquid storage body does not easily come into contact with the curved portion. It is possible to secure a greater waste liquid storage volume of the waste liquid storage body as compared to a configuration in which enough space is secured for a slide stroke such that the waste liquid storage body does not come into contact with the curved portion and the waste liquid storage body is caused to slide to the curved portion side to remove the waste liquid storage body.

What is claimed is:

1. A liquid ejecting apparatus comprising:

a transport section which transports a medium in a transport direction;

a liquid ejecting head which ejects a liquid onto the medium;

a head support portion which supports the liquid ejecting head;

a liquid storage container which stores the liquid to be supplied to the liquid ejecting head;

a discharge section which discharges the medium onto which the liquid is ejected, the discharge section comprising a roller pair; and a holding section which holds a waste liquid storage body configured to store the liquid eliminated from the liquid ejecting head as a waste liquid, wherein the holding section is disposed at a position downstream of the head support portion in the transport direction and overlaps the roller pair of the discharge section in a direction transverse to the transport direction.

2. The liquid ejecting apparatus according to claim 1, wherein the discharge section includes two rollers disposed at different positions in the transport direction.

3. The liquid ejecting apparatus according to claim 1, wherein the transport section includes a second transport path in which the medium is transported after the liquid is ejected thereon in a second transport direction which is an opposite direction from the transport direction below a first transport path in which the medium is transported, the discharge section feeds the medium to the second transport path by discharging the medium partway in the transport direction and subsequently transporting the medium in reverse in the second transport direction, and the holding section is positioned at a position downstream of the head support portion in the transport direction and above the second transport path.

4. The liquid ejecting apparatus according to claim 1, further comprising:

a housing which stores the liquid ejecting head and the holding section, wherein the housing includes a discharge port from which the medium is discharge, and the holding section is disposed above the discharge port.

5. The liquid ejecting apparatus according to claim 4, wherein the head support portion is a carriage configured to reciprocally move in scanning directions which intersect the transport direction at a position above a transport path of the medium, the liquid ejecting head moves together with the carriage, and the holding section is disposed at a position downstream of the carriage in the transport direction and above the discharge section.

6. The liquid ejecting apparatus according to claim 5, further comprising:

a maintenance device which performs maintenance on the liquid ejecting head in a state in which the carriage is positioned at a maintenance position which is one end portion of a movement path of the carriage, wherein the holding section is positioned close to one side which is an opposite side from the maintenance position in movement directions of the carriage inside the housing.

7. The liquid ejecting apparatus according to claim 6, further comprising:

a tube through which a liquid supplied to the liquid ejecting head from the liquid storage container disposed at a different position from the carriage passes;

a waste liquid tube through which a waste liquid pumped from the maintenance device to the waste liquid storage body passes; and a partitioning wall portion which separates the tube and the waste liquid tube from each other.

8. The liquid ejecting apparatus according to claim 7, wherein the holding section includes a coupling portion which couples the waste liquid storage body to the waste liquid tube, and the holding section is provided with an attaching/detaching mechanism which attaches and detaches the waste liquid storage body with respect to the holding section to configure the waste liquid storage body to couple to and be removed from the coupling portion by causing the waste liquid storage body to slide in the movement directions of the carriage.

9. The liquid ejecting apparatus according to claim 8, wherein the tube is provided to form a curved portion which curves and doubles back toward downstream in the transport direction and to cause a formation position of the curved portion to move in accordance with movement of the carriage, and in the attaching/detaching mechanism, the waste liquid storage body is removed by sliding the waste liquid storage body in a direction toward an opposite side from a side on which the curved portion is positioned in the movement directions of the carriage.

10. The liquid ejecting apparatus according to claim 5, comprising:

the liquid storage container disposed at a different position from the carriage, wherein the holding section is positioned close to one side which is the same side as a side on which the liquid storage container is disposed in movement directions of the carriage inside the housing.

11. The liquid ejecting apparatus according to claim 5, further comprising:

a tube which is coupled to the carriage and through which a liquid supplied to the liquid ejecting head from the liquid storage container disposed at a different position from the carriage passes, wherein a bottom end of the holding section is positioned below the tube.

12. The liquid ejecting apparatus according to claim 5, wherein a top end of the waste liquid storage body held by the holding section is positioned above a top end of the carriage.

13. The liquid ejecting apparatus according to claim 1, further comprising:

a housing which stores the liquid ejecting head and the holding section; and a cover configured to open and close which covers an opening in a top portion of the housing, wherein the holding section holds the waste liquid storage body in an exposed state when the cover is opened.

* * * * *